US010307760B2

(12) United States Patent
Toner et al.

(10) Patent No.: US 10,307,760 B2
(45) Date of Patent: Jun. 4, 2019

(54) INERTIO-ELASTIC FOCUSING OF PARTICLES IN MICROCHANNELS

(71) Applicants: The General Hospital Corporation, Boston, MA (US); Massachusetts Institute of Technology, Cambridge, MA (US)

(72) Inventors: Mehmet Toner, Charlestown, MA (US); Gareth McKinley, Acton, MA (US); Eugene Lim, Charlestown, MA (US); Thomas Ober, Cambridge, MA (US)

(73) Assignees: The General Hospital Corporation, Boston, MA (US); Massachusetts Institute of Technology, Cambridge, MA (US)

( * ) Notice: Subject to any disclaimer, the term of this patent is extended or adjusted under 35 U.S.C. 154(b) by 106 days.

(21) Appl. No.: 15/114,050

(22) PCT Filed: Jan. 30, 2015

(86) PCT No.: PCT/US2015/013892
§ 371 (c)(1),
(2) Date: Jul. 25, 2016

(87) PCT Pub. No.: WO2015/116990
PCT Pub. Date: Aug. 6, 2015

(65) Prior Publication Data

US 2016/0339434 A1 Nov. 24, 2016

Related U.S. Application Data

(60) Provisional application No. 61/933,643, filed on Jan. 30, 2014.

(51) Int. Cl.
*B01L 99/00* (2010.01)
*B01L 3/00* (2006.01)

(52) U.S. Cl.
CPC ..... *B01L 3/502776* (2013.01); *B01L 3/50273* (2013.01); *B01L 3/502715* (2013.01);
(Continued)

(58) Field of Classification Search
CPC ..... B01L 3/502776; B01L 2200/0636
See application file for complete search history.

(56) References Cited

U.S. PATENT DOCUMENTS

2004/0043506 A1* 3/2004 Haussecker ..... B01F 13/0062 436/180
2005/0095711 A1* 5/2005 More ..... C12M 21/08 435/395

(Continued)

FOREIGN PATENT DOCUMENTS

WO WO 2013/192310 12/2013

OTHER PUBLICATIONS

International Preliminary Report on Patentability in International Application No. PCT/US2015/013892, dated Aug. 11, 2016, 13 pages.

(Continued)

*Primary Examiner* — Paul S Hyun
(74) *Attorney, Agent, or Firm* — Fish & Richardson P.C.

(57) ABSTRACT

One example of systems and methods for inertio-elastic focusing of particles in microchannels includes a substrate including a channel having an inlet and an outlet. A viscoelastic fluid, i.e., a fluid having a dynamic viscosity that varies with shear rate, and that carries suspended particles is driven through the channel. The volumetric flow rate at which the fluid is driven results in the formation of a localized pathline in the fluid at or near a center of the channel. The localized pathline defines a width that is equal (Continued)

to or slightly greater than a hydraulic diameter of the particle. The particles in the fluid are focused into the localized pathline.

17 Claims, 16 Drawing Sheets

(52) U.S. Cl.
CPC ... *B01L 2200/0636* (2013.01); *B01L 2200/12* (2013.01); *B01L 2400/0487* (2013.01)

(56) References Cited

U.S. PATENT DOCUMENTS

| | | | | |
|---|---|---|---|---|
| 2006/0023207 | A1 | 2/2006 | Cox et al. | |
| 2009/0014360 | A1* | 1/2009 | Toner | B01D 21/0087 209/208 |
| 2010/0178666 | A1 | 7/2010 | Leshansky et al. | |
| 2012/0035061 | A1* | 2/2012 | Bransky | G01N 15/147 506/7 |
| 2013/0302885 | A1 | 11/2013 | Lai et al. | |
| 2015/0226657 | A1* | 8/2015 | Foster | G01N 15/10 435/287.1 |

OTHER PUBLICATIONS

International Search Report and Written Opinion in International Application No. PCT/US2015/013892, dated Apr. 29, 2015, 14 pages.

D'Avino et al., "Single line particle focusing induced by viscoelasticity of the suspending liquid: theory, experiments and simulations to design a micropipe flow-focuser," Lab Chip, 2012, 12:1638-1645.

Del Giudice et al., "Particle alignment in a viscoelastic liquid flowing in a square-shaped microchannel," Lab Chip, 2013, 13: 4263-4271.

Ho and Leal, "Migration of rigid spheres in a two-dimensional unidirectional shear flow of a second-order fluid," J. Fluid Mech, 1976, 76: 783-799.

Kang et al., "DNA-based highly tunable particle focuser," Nat. Commun, 2013, 4: 2567.

Leshansky et al., "Tunable nonlinear viscoelastic 'focusing' in a microfluidic device," Phys. Rev. Lett, 2007, 98: 234501.

Villone et al., "Particle motion in square channel flow of a viscoelastic liquid: migration versus secondary flows," J. Non-Newton. Fluid, 2013, 195: 1-8.

Yang et al., "Sheathless elasto-inertial particle focusing and continuous separation in a straight rectangular microchannel," Lab Chip, 2011, 11: 266-273.

* cited by examiner

PDMS Replica s-PDMS Replica s-PDMS Replica

PDMS Master

PDMS Master

Epoxy Replica

Epoxy Replica e-Glass Slide

PBS $HA_{1650}$ $a_p = 1$ μm $a_p = 3$ μm $a_p = 6$ μm $a_p = 8$ μm

INERTIO-ELASTIC FOCUSING OF PARTICLES IN MICROCHANNELS

CROSS-REFERENCE TO RELATED APPLICATIONS

This application is a U.S. national stage application under 35 USC § 371 of International Application No. PCT/US2015/013892, filed on Jan. 30, 2015, which claims priority to U.S. Provisional Patent Application No. 61/933,643, filed on Jan. 30, 2014, the entire contents of all of which are incorporated herein by reference.

TECHNICAL FIELD

This specification relates to focusing particles, e.g., biological particles, in microchannels, e.g., formed in microfluidic devices, at different volumetric flow rates resulting in different Reynolds numbers.

BACKGROUND

The ability to continuously manipulate and separate particles or cells from fluids at high throughput finds application in many biomedical, environmental and industrial processes. Microfluidic technologies such as immunoaffinity capture, deterministic lateral displacement, and microporous filtration have been used to sort cells from bodily fluids. However, such technologies are typically characterized by low throughput. More recently, directed inertial focusing of particles towards specific fluid streamlines in straight and curved microchannels in Newtonian fluids (of density $\rho$ and viscosity $\mu$) has been demonstrated at moderate Reynolds numbers ($Re=\rho UH/\mu\approx100$) where U is the particle velocity and H is the channel cross-sectional dimension.

SUMMARY

This disclosure relates to inertio-elastic focusing of particles in microchannels. The techniques described herein can be implemented to achieve inertio-elastic focusing of particles (e.g., rigid beads, mammalian cells, hydrogel particles, and other biological or synthetic particles) in a viscoelastic fluid at Reynolds numbers up to 10,000.

Certain aspects of the subject matter described here can be implemented as a method for focusing particles suspended within a moving fluid. A substrate including a channel having an inlet and an outlet is provided. A fluid having a dynamic viscosity that varies with shear rate and that carries suspended particles is driven through the channel. The volumetric flow rate at which the fluid is driven results in the formation of a localized pathline in the fluid at or near a center of the channel. The localized pathline defines a width that is substantially equal to or slightly greater than a hydraulic diameter of the particle. The particles in the fluid are focused into the localized pathline.

This, and other aspects, can include one or more of the following features. The fluid can include a drag-reducing polymer added to a Newtonian fluid (e.g., water or physiological saline solution). The drag-reducing polymer can include hyaluronic acid (HA). The molecular weight of HA can be between 350 kDa and 1650 kDa. The channel can have either a square or cylindrical cross-section. The Reynolds number of the fluid flow can be between 100 and 4500, e.g., between 100 and 4000, 200 and 4000, 400 and 3000, 500 and 2000, 1000 and 1500. For a channel with 80-μm square cross-section, this corresponds to a volumetric flow rate of between 0.6 ml/min and 50 ml/min (which translates to shear rates of between $10^3$ $s^{-1}$ and $10^7$ $s^{-1}$). The localized pathline can be formed along a central axis of the channel. The suspended particles can include polystyrene beads, white blood cells, or poly(ethylene) glycol particles (among other particles with comparable dimensions to plant and mammalian cells). The hydraulic diameter of the polystyrene beads can range between 1 μm and 8 μm. The suspended particles can include white blood cells (WBCs). A WBC can be defined by an aspect ratio (AR) defined as a ratio of a WBC diameter along an X-axis ($a_x$) and a WBC diameter along a Z-axis ($a_z$). The aspect ratio of the WBCs can be between 1.4 and 2.5.

Certain aspects of the subject matter described here can be implemented as a method for focusing particles suspended within a moving fluid. A substrate including a channel having an inlet and an outlet is provided. A fluid that carries suspended particles is driven through the channel at a volumetric flow rate resulting in a Reynolds number greater than 100, e.g., greater than 200. The driving results in forming a localized pathline in the fluid. The localized pathline defines a width that is substantially equal to or greater than a hydraulic diameter of the particle. The particles in the fluid are focused into the localized pathline.

This, and other aspects, can include one or more of the following features. The fluid can have a dynamic viscosity that varies with shear rate. The shear rate can be between $10^3$ $s^{-1}$ and $10^7$ $s^{-1}$. The fluid can include a drag-reducing polymer mixed with a Newtonian fluid. The drag-reducing polymer can include hyaluronic acid (HA). A molecular weight of the HA can be between 350 kDa and 1650 kDa the channel can have either a square or cylindrical cross-section. The localized pathline can be formed along a central axis of the channel. The suspended particles can include polystyrene beads. The hydraulic diameter of the polystyrene beads can range between 1 μm and 8 μm. The suspended particles can include white blood cells (WBCs). A WBC can be defined by an aspect ratio (AR) defined as a ratio of a WBC diameter along an X-axis ($a_x$) and a WBC diameter along a Z-axis ($a_z$). The aspect ratio of the WBCs can be between 1.4 and 2.5.

Certain aspects of the subject matter described here can be implemented as a system for focusing particles suspended within a moving fluid. The system includes a substrate including a channel having an inlet and an outlet. The system is designed for use with a fluid having a dynamic viscosity that varies with shear rate and that carries suspended particles. In some implementations, the system can include the fluid. The system includes a pump configured to drive the fluid through the channel at a volumetric flow rate that results in the formation of a localized pathline in the fluid at or near a center of the channel. The localized pathline defines a width that is substantially equal to or greater than a hydraulic diameter of the particle. During use, the system focuses the particles in the fluid into the localized pathline.

This, and other aspects, can include one or more of the following features. The fluid can include a drag-reducing polymer mixed with a Newtonian fluid. The drag-reducing polymer can include hyaluronic acid (HA). A molecular weight of the HA can be between 350 kDa and 1650 kDa. The shear rate can be between $10^3$ $s^{-1}$ and $10^7$ $s^{-1}$. The volumetric flow rate can be between 0.6 ml/min and 50 ml/min. The Reynolds number of the flow can be between 100 and 4500. The channel can have either a square or cylindrical cross-section. The localized pathline can be formed along a central axis of the channel. The suspended particles can include polystyrene beads. The hydraulic diameter of the polystyrene beads can range between 1 μm and 8 μm. The suspended particles can include white blood cells (WBCs). A WBC can be defined by an aspect ratio (AR) defined as a ratio of a WBC diameter along an X-axis ($a_x$) and a WBC diameter along a Z-axis ($a_z$). The aspect ratio of the WBCs can be between 1.4 and 2.5.

Certain aspects of the subject matter described here can be implemented as a system for focusing particles suspended within a moving fluid. The system includes a substrate including a channel having an inlet and an outlet. The system includes a fluid that carries suspended particles. The system includes a pump to drive the fluid through the channel at a volumetric flow rate resulting in a Reynolds number greater than 2000. The driving results in forming a localized pathline in the fluid. The localized pathline defines a width that is substantially equal to or greater than a hydraulic diameter of the particle. During use, the system focuses the particles in the fluid into the localized pathline.

This, and other aspects, can include one or more of the following features. The fluid can have a dynamic viscosity that varies with shear rate. The shear rate can be between $10^3$ $s^{-1}$ and $10^7$ $s^{-1}$. The fluid can include a drag-reducing polymer mixed with a Newtonian fluid. The drag-reducing polymer can include hyaluronic acid (HA). A molecular weight of the HA can be between 350 kDa and 1650 kDa. The channel can have either a square or cylindrical cross-section. The localized pathline can be formed along a central axis of the channel. The suspended particles can include polystyrene beads. The hydraulic diameter of the polystyrene beads can range between 1 μm and 8 μm. The suspended particles can include white blood cells (WBCs). A WBC can be defined by an aspect ratio (AR) defined as a ratio of a WBC diameter along an X-axis ($a_x$) and a WBC diameter along a Z-axis ($a_z$). The aspect ratio of the WBCs can be between 1.4 and 2.5. A microfluidic channel (sometimes referred to as a microchannel) can include a fluid flow pathway formed on a substrate with a cross-sectional dimension on the order of microns (e.g., between 1 μm and 1000 μm). The microfluidic channel can have any cross-sectional shape (e.g., rectangular, triangular, square, circular, shapes with varying dimensions, combinations of shapes, or features present within various shapes). The microfluidic channel can have any longitudinal shape (e.g., straight, curved, combinations of these and other shapes).

A "sample" (sometimes referred to as "fluid" or "fluid sample") is capable of flowing through the microfluidic channel. The sample can include one or more of a fluid suspension or any sample that can be put into the form of a fluid suspension, and that can be driven through the microfluidic channel.

A fluid can include any type of fluid, e.g., water such as in ponds, aquariums, or other bodies that hold water or other type of fluid. The fluid can include industrial fluids, environmental fluids or fluids used by other entities that disperse particles in such fluids for industrial or other types of processing. The fluid can include biological fluids, e.g., whole blood, peritoneal, branchioalveolar, ascites, urine type or other bodily fluids. The particles dispersed in the fluid can include biological particles, e.g., circulating tumor cells, red blood cells, white blood cells, or other types of biological particles that occur either naturally or are introduced artificially into the fluid.

Particles suspended within a sample can have any size which allows them to be ordered and focused within the microfluidic channel. For example, particles can have a hydrodynamic size that is between 1 μm and 100 μm. The particle size is limited only by channel geometry; accordingly, particles that are larger and smaller than the above-described particles and focused with the microchannel can be used.

In some implementations, focusing (sometimes referred to as "localizing") can be achieved by varying a flow rate of a fluid carrying suspended particles flowed through a channel of constant cross-section. In some implementations, focusing can be achieved by a reduction in the area of a cross-section of a channel through which a flux of particles passes. Particles can be localized within an area having a width of, e.g., 1.05, 2, 3, 4, or 5 times the width of the particles. Localization can occur at any location within the channel, e.g., at an unobstructed portion of the channel. Localization can occur in a portion of the channel having less than 50%, 40%, 30%, 20%, 10%, 5%, 2%, 1%, or 0.1% reduction in cross-sectional area.

Implementations of the subject matter described below can provide enhanced inertio-elastic focusing of particles, e.g., rigid spherical beads, deformable white blood cells (WBCs), and anisotropic polyethylene glycol (PEG) particles using a common polymeric drag-reducing agent, e.g., hyaluronic acid (HA). The inertio-elastic focusing occurs in a previously unexplored regime of Reynolds and Weissenberg numbers that can be accessed through the use of a rigid microfluidic device. Implementations of the subject matter can also demonstrate that there is a complex interaction between inertial effects in the flow and the viscoelastic fluid rheology that governs the migration, orientation and deformation of large (non-Brownian) particles suspended in the fluid. By varying the cross-sectional channel shape, the polymer molecular weight as well as the particle size and deformability, implementations can demonstrate that it is not shear-thinning or the presence of secondary flows in the channel but elastic normal stresses in the fluid that drive the strong centerline focusing behavior observed. The techniques described below can be implemented to process samples at rates of up to 3 $L \cdot hr^{-1}$ (and linear velocities of 460 $km \cdot hr^{-1}$) in a single microchannel via inertio-elastic particle focusing. Such techniques can be used for rapid isolation of tumor cells from large volumes of bodily fluid samples (e.g., peritoneal washings, bronchoalveolar lavages, urine), high-throughput intracellular delivery of macromolecules for therapeutic application, scanning of multifunctional encoded particles for rapid biomolecule analysis, removal of floc aggregates within water treatment systems, combinations of them, or other applications.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIGS. 10B and 10D are cross-sectional images of a borosilicate glass microchannel with square cross-section (inner dimension=50 μm) and cylindrical cross-section (inner diameter=50 μm), respectively. FIGS. 10A and 10C are three-dimensional bar graphs showing particle distributions across the channel widths over a range of flow rates in the microchannels of FIGS. 10B and 10D, respectively.

Like reference numbers and designations in the various drawings indicate like elements.

DETAILED DESCRIPTION

This disclosure describes hydrodynamic implementations to deterministically focus particles (e.g., beads, mammalian cells, anisotropic hydrogel particles, other particles, or combinations of them) carried by a fluid in a microchannel through which the fluid is flowed at high flow rates. As described below, the addition of specified concentrations (e.g., micromolar concentrations or other concentrations) of one or more drag-reducing polymers (e.g., hyaluronic acid (HA)) results in a fluid viscoelasticity that can be used to control the focal position of the particles at different Reynolds numbers (Re), e.g., Re≈10,000, with corresponding flow rates and particle velocities up to 50 ml·min$^{-1}$ and 130 m·s$^{-1}$, respectively. The controlled manipulation of cell-sized particles in a Newtonian fluid (e.g., water) in the absence of the drag-reducing polymer (i.e., HA) at Re beyond 2500±500 was not possible due to the onset of inertial turbulence. As demonstrated herein, the presence of viscoelastic normal stresses are more significant than the secondary flows or shear-thinning in the fluid rheology to drive the deterministic particle migration in fluids that include the drag-reducing polymer.

By implementing the techniques described here, inertio-elastic fluid flow in a previously unattained regime and particle focusing at high flow rates can be achieved. The microfluidic devices built to study the inertio-elastic focusing could withstand pressure drops as high as 5000 PSI ($3.4\times10^7$ Pa) depending on channel dimensions and operating flow rate. In addition, techniques to track individual particles with particle velocities that can easily exceed 100 m/s were also developed. Potential applications of inertio-elastic fluid flow include (but are not limited to): 1) isolation of bioparticles (e.g., tumor cells, bacteria cells) from large volumes of bodily fluid samples (e.g., whole blood, peritoneal washings, bronchoalveolar lavages, urine), 2) delivery of macromolecules (e.g., carbon nanotubes, proteins, siRNA) to mammalian or plant cells (e.g., embryonic stem cells, immune cells, algae cells), 3) scanning of multifunctional encoded particles for biomolecule analysis, and 4) removal of floc aggregates within water treatment systems.

Figure 1:
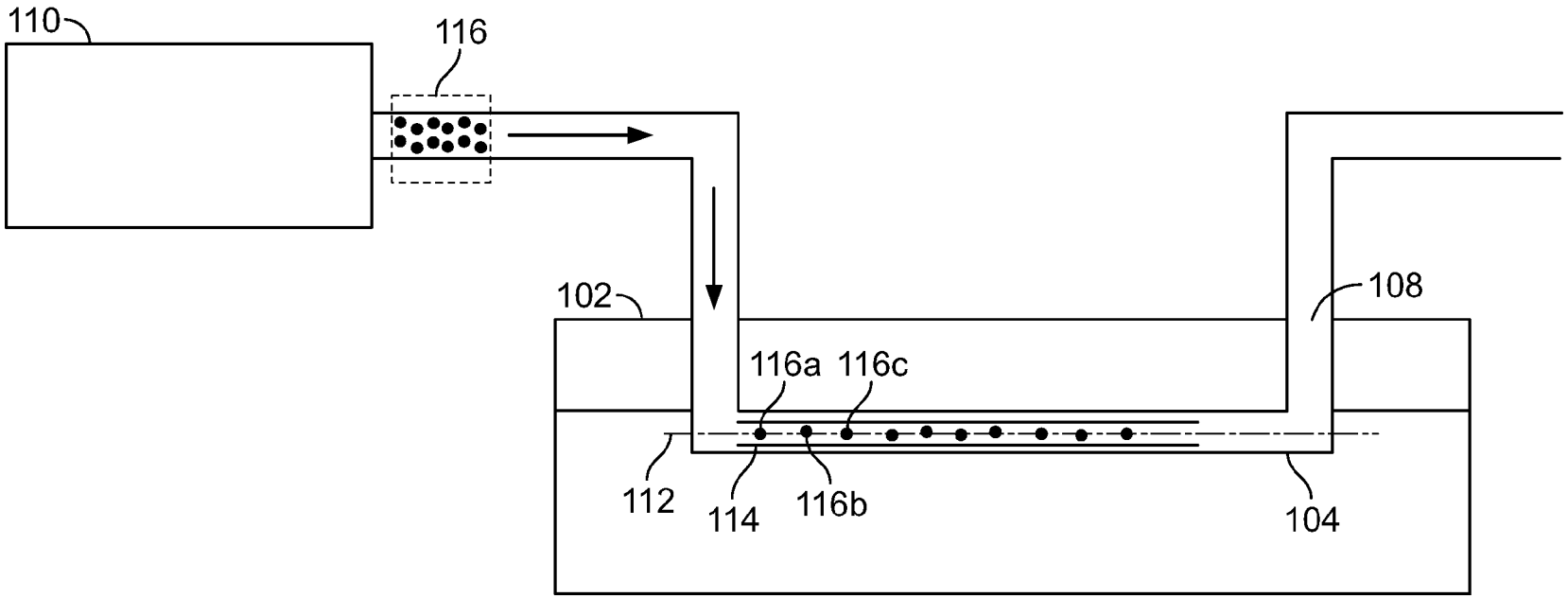
FIG. 1 is a schematic diagram of a side view of one example of a system as described herein for focusing particles suspended within a moving fluid as described herein.

FIG. 1 is a schematic diagram of a side view of an example of a system for focusing particles suspended within a moving fluid. The system includes a substrate 102 including a channel 104 (e.g., a microchannel) having an inlet 106 and an outlet 108. A pump 110 is connected to the inlet 106 of the channel 104. The pump 110 is operated to drive a fluid that carries suspended particles 116 through the channel 104. In some implementations, the pump 110 is operated to drive the fluid through the channel 104 at a volumetric flow rate that results in the formation of a localized pathline 114 in the fluid at or near a center of the channel 104, e.g., defined by the axis 112. The localized pathline 114 defines a width that is substantially equal to or greater than a hydraulic diameter of the particle (e.g., the particle 116*a*, the particle 116*b*, the particle 116*b*, or other particles). The particles in the fluid are focused into the localized pathline 114. The localized pathline 114 represents a portion of the fluid into which the suspended particles 116 are focused. That is, the suspended particles are focused into a streamline formed by the fluid flow at or near a center of the channel 104.

Figure 2:
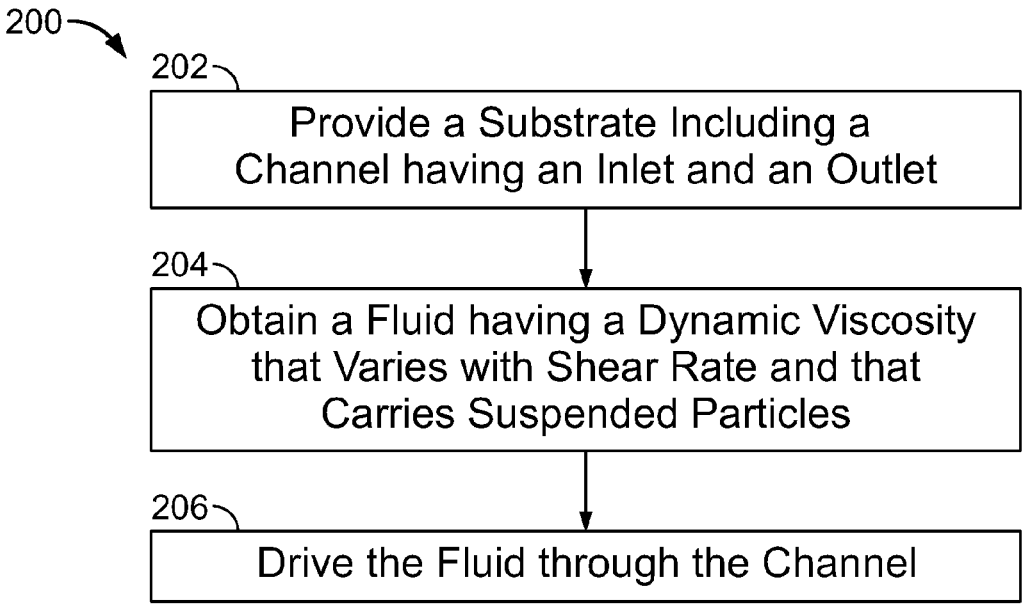
FIG. 2 is a flowchart of one example of a process as described herein for focusing particles suspended within a moving fluid.

FIG. 2 is a flowchart of an example of a process 200 for focusing particles suspended within a moving fluid. At 202, the substrate 102 including the channel 104 that has the inlet 106 and the outlet 108 is provided. At 204, a fluid having a dynamic viscosity that varies with shear rate and that carries the suspended particles 116 is obtained. For example, the fluid can be viscoelastic and shear-thinning. The fluid is driven through the channel 104 at a volumetric flow rate that results in the formation of the localized pathline 114 in the fluid at or near a center of the channel (e.g., defined by the axis 112). The localized pathline 114 defines a width that is substantially equal to or greater than a hydraulic diameter of the particle. The particles in the fluid are focused into the localized pathline. When the particles 116 are initially flowed into the channel 104, the particles 116 are randomly dispersed. That is, each particle is at a random location relative to a center of the channel. Being focused in the localized pathline means that, when the particles flow through the channel 104 at the volumetric flow rates described below, the randomly dispersed particles are moved from their respective locations to a location within the width of the localized pathline 114. For the duration that the particles 116 flow through the channel 112, and for which the volumetric flow rates are those described below, the particles 116 remain within the width of the localized pathline 114. Within the width of the localized pathline, some particles may be aligned with the center 112 of the axis, while other particles may be offset relative to the center 112 of the axis. Nevertheless, all the particles 116 remain within the localized pathline 114.

Channel Fabrication and Design

Figure 3A:
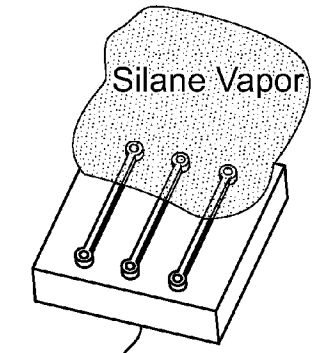
FIGS. 3A-3H are schematic diagrams of examples of processes for fabricating a microfluidic device that includes a microchannel for focusing particles suspended within a moving fluid.
Figure 3B:
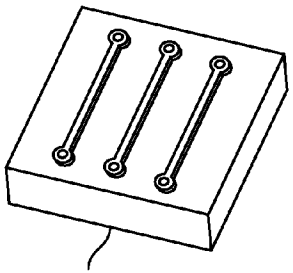
Figure 3C:
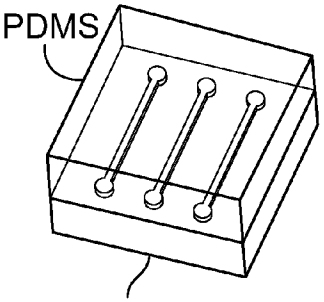
Figure 3D:
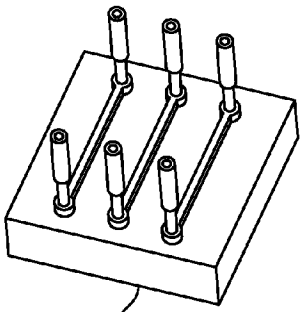
Figure 3E:
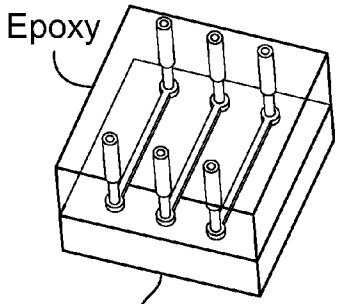
Figure 3F:
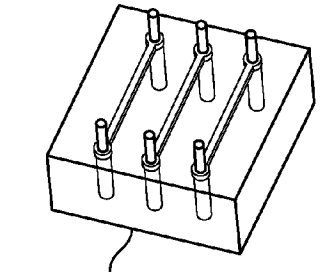
Figure 3G:
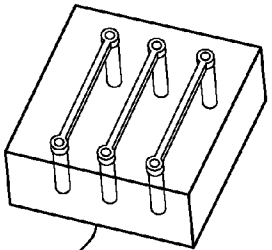
Figure 3H:
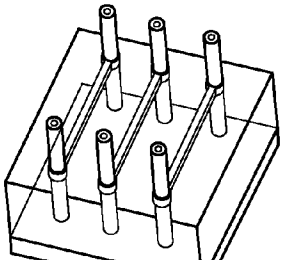
Figure 3I:
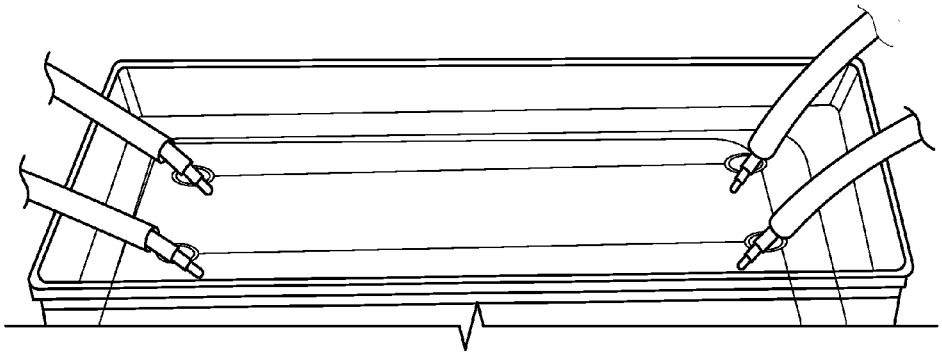
FIG. 3I is a schematic diagram of a PDMS master used to fabricate the microfluidic device using the example processes of FIGS. 3A-3H.
Figure 3J:
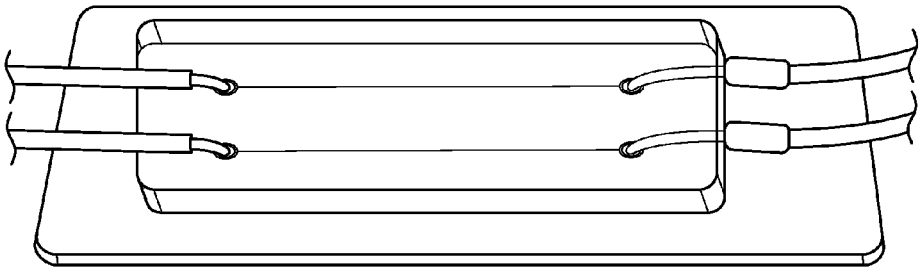
FIG. 3J is a schematic diagram of a microfluidic device fabricated using the example processes of FIGS. 3A-3H starting with the PDMS master of FIG. 3I.

FIGS. 3A-3H are schematic diagrams of examples of processes for fabricating a microfluidic device that includes a microchannel for focusing particles suspended within a moving fluid. The microfluidic device can be made using different materials, e.g., epoxy or non-epoxy materials, that can withstand the pressures generated by flowing fluids at high pressures. For the construction of the devices, channel features can be created, e.g., using computer-aided design software (e.g., AutoCAD) and printed on a mask. A photoresist, such as SU-8 photoresist, (e.g., from MicroChem) or other photoresist can be used to produce a master consisting of channels of desired shape, e.g., straight line or other shape, and desired dimension, e.g., desired length, width, or other dimension. Inlet and outlet holes can be punched on an outer surface of the microfluidic device. Cords, e.g., Teflon cord (McMaster-Carr), can be inserted into the inlet and/or outlet holes, and be connected to fluid flow devices, e.g., pumps, to flow fluids through the microchannel. FIG. 3B is the PDMS master mold used to fabricate epoxy replica molds. FIG. 3I is a schematic diagram of a PDMS master used to fabricate the microfluidic device using the example processes of FIGS. 3A-3H. FIG. 3J is a schematic diagram of a microfluidic device fabricated using the example processes of FIGS. 3A-3H starting with the PDMS master of FIG.

Design Parameters for Microchannel Dimensions

Figure 4A:
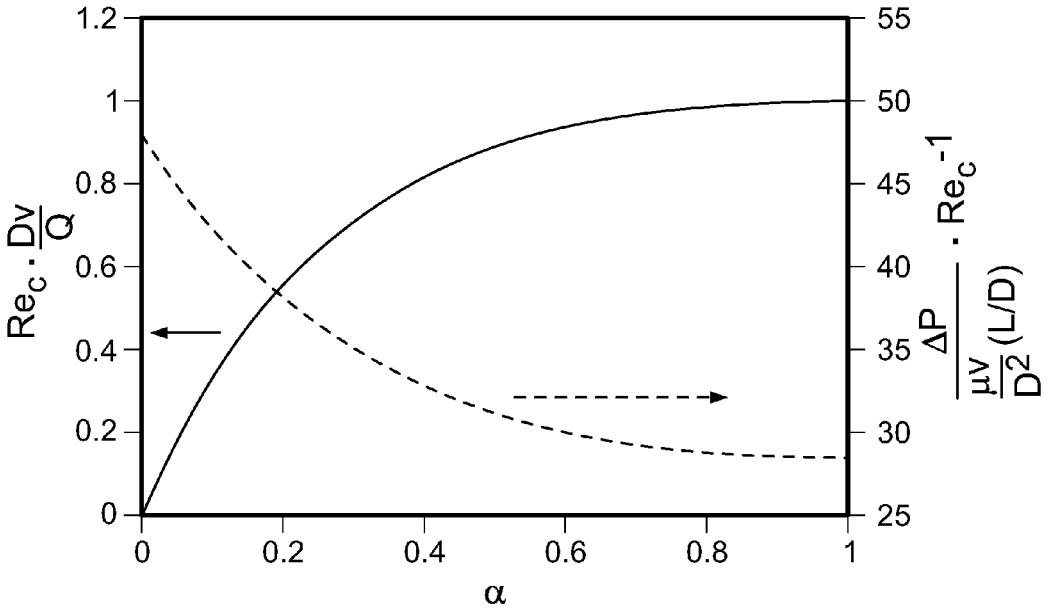
FIGS. 4A and 4B are plots showing design parameters for microchannel dimensions.
Figure 4B:
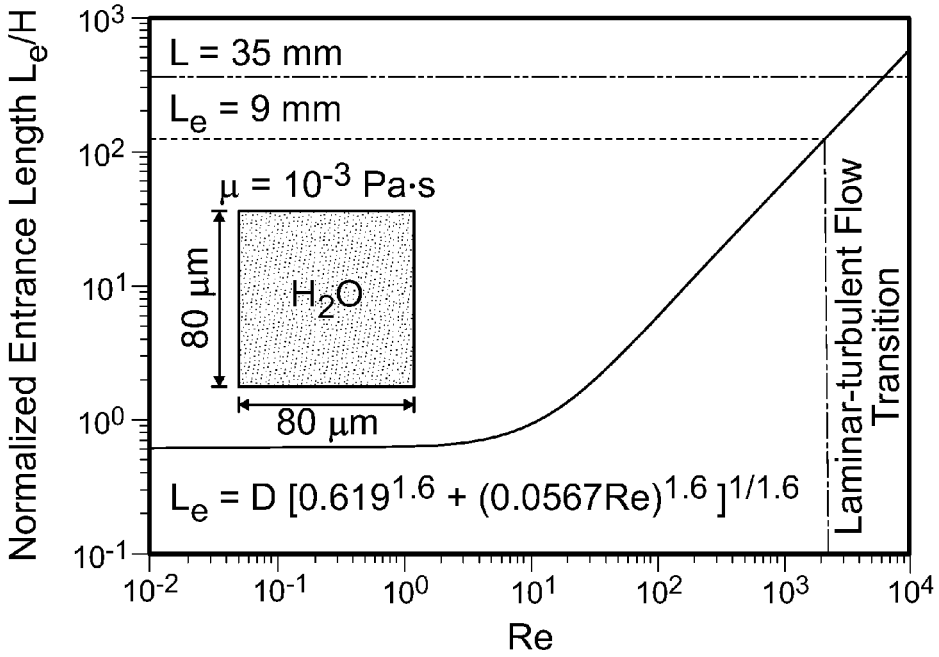

FIGS. 4A and 4B are examples of plots shown design parameters for microchannel dimensions. The height H and width W of the channel cross-section were chosen to maximize the Reynolds number for a given volumetric flow rate Q and hydraulic diameter D=2HW/(H+W). The channel Reynolds number $Re_c$ can be expressed as shown in Equation 1.

$$Re_c = \frac{QD}{HW\nu} = \frac{4Q}{D\nu}\frac{\alpha}{(1+\alpha)^2} \tag{1}$$

In Equation 1, v is the kinematic viscosity of the fluid and $\alpha$=W/H is the aspect ratio (with the constraint that $0\leq\alpha\leq1$). For a constant ratio of Q/D, the value of $Re_c$ is maximized when $\alpha$=1. The length L of the channel was chosen to ensure that the flow was hydrodynamically fully-developed for all $Re_c$ over which the flow was laminar. FIG. 4A shows a plot of channel Reynolds number ($Re_c$) normalized for a constant ratio of Q/D, and friction factor normalized for a constant value of $Re_c$ as a function of channel aspect ratio $\alpha$=W/H. For the flow of a Newtonian fluid in a rectilinear duct, the hydrodynamic entrance length $L_e$ can be expressed as shown in Equation 2.

$$L_e = D[0.619^{1.6} + (0.0567Re_c)^{1.6}]^{\frac{1}{1.6}} \tag{2}$$

Equation 2 specifies an additional condition that $L_e<L<L_s$, where $L_s$ is the length of the epoxy-coated glass slide. FIG. 4B shows a plot of hydrodynamic entrance length as a function of $Re_c$. The transition to inertially-dominated turbulence is expected to occur at $Re_c\approx2000$, which suggests that $L_e$=113D. For polystyrene beads with particle diameter a=8 μm, the hydraulic diameter was set as D=W=H=80 μm such that the ratio of particle diameter to channel dimension a/D≥0.1. This ensured that the particle Reynolds number is $Re_p$~O(1) for $Re_c$<2000. For a straight channel with 80-μm square cross-section, the channel length was set as L=3.50 mm, which significantly exceeded the entrance length $L_e$=0.90 mm for $Re_c$~2000.

Sample Preparation

The fluid in which the particles 116 are suspended and which is flowed through the channel 112 can include a Newtonian fluid, e.g., water or other Newtonian fluid, or a drag-reducing polymer mixed with a Newtonian fluid. In general, any polymer (or material) that can decrease a drag on particles, e.g., by exerting viscoelastic normal stresses on the particles, at the volumetric flow rates described herein can be implemented as an alternative or in addition to HA. In other words, any material (e.g., polymer, or other material) which, when mixed with a Newtonian fluid, alters a drag on a particle suspended in the fluid-material mixture, relative to a drag on the particle suspended in the Newtonian fluid without the material can be implemented as an alternative or in addition to HA. Such materials can include, e.g., polyethylene oxide (PEO), polyacrylamide, gelatin, to name a few. The particles can include rigid particles, e.g., beads, or deformable particles. In some implementations, the particles can include biological particles, e.g., cells.

Rheological Measurements of HA Solutions

The viscosities of the fluids can be tested using a viscometer, e.g., a stress-controlled rheometer (DHR-3, TA Instruments) or a microfluidic viscometer-rheometer-on-a-chip (VROC, Rheosense) (FIG. 5), or both. The DHR-3 instrument imposed an increasing shear rate ramp on a fluid sample contained within a double-gap cylindrical Couette cell. The viscosity of the fluid sample was measured on the DHR-3 instrument for shear rates $0.1<\dot{\gamma}<3\times10^3\ s^{-1}$. The VROC microfluidic chip consists of a borosilicate glass microchannel with a rectangular slit cross-section and a silicon pressure sensor array. The viscosity of the fluid sample was measured on the VROC device for shear rates $5\times10^3<\dot{\gamma}<3.3\times10^5\ s^{-1}$. To numerically predict the velocity profiles in the channel, the measured flow curve of the native sample was fit with the Carreau model represented by Equation 3.

$$\eta(\dot{\gamma}) = \eta_\infty - (\eta_0 - \eta_\infty)[1 + (\dot{\gamma}/\dot{\gamma}^*)^2]^{\frac{n-1}{2}} \tag{3}$$

Figure 5:
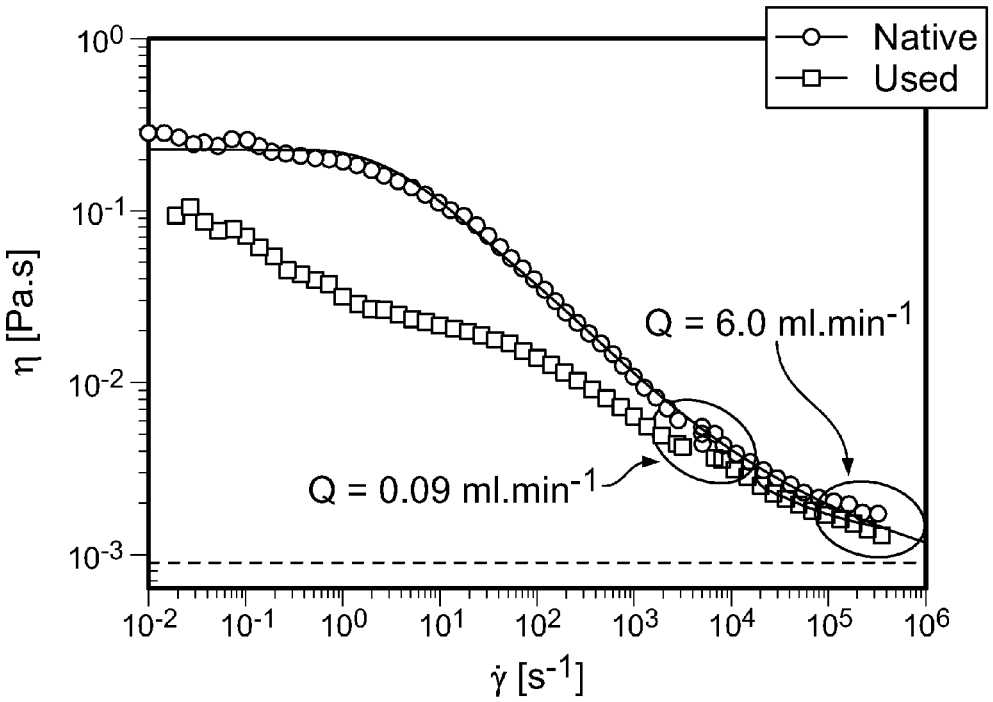
FIG. 5 is a plot showing rheological measurements of fluids that include drag-reducing polymers.

In Equation 3, $\eta_\infty$ is the infinite-shear-rate viscosity, $\eta_0$ is the zero-shear-zero-shear-rate viscosity, $\dot{\gamma}^*$ is a characteristic shear rate at the onset of shear-thinning, and n is the "power-law exponent". FIG. 5 shows a flow curve of HA solution before use ("native") and after use ("used") at flow rates up to Q=20 ml·min$^{-1}$. Carreau model fit to unused HA solution, $\eta_0$=230 mPa·s, $\eta_{28}$=0.9 mPa·s, $\dot{\gamma}$=0.36 $s^{-1}$, n=0.48. Water viscosity ($\mu_w$=0.9 mPa·s) is shown by the horizontal dashed line.

The fluid viscosity of both native and used samples of HA solution were measured at Q=20 ml·min$^{-1}$ to investigate the role of shear-induced sample degradation. The viscosity of native HA solution exceeded the viscosity of used HA solution by at least a factor of 2 for shear rates $0.1<\dot{\gamma}<10^3\ s^{-1}$ presumably due to the shear-induced disruption of aggregates in the solution. However, the measured difference in HA viscosity between the samples was minimal and remained unchanged after repeated shearing for high shear rates ($10^3<\dot{\gamma}<10^7\ s^{-1}$). This suggests that irreversible polymer degradation had little to no effect on HA viscosity at the flow rates where particle focusing was observed.

Figure 6:
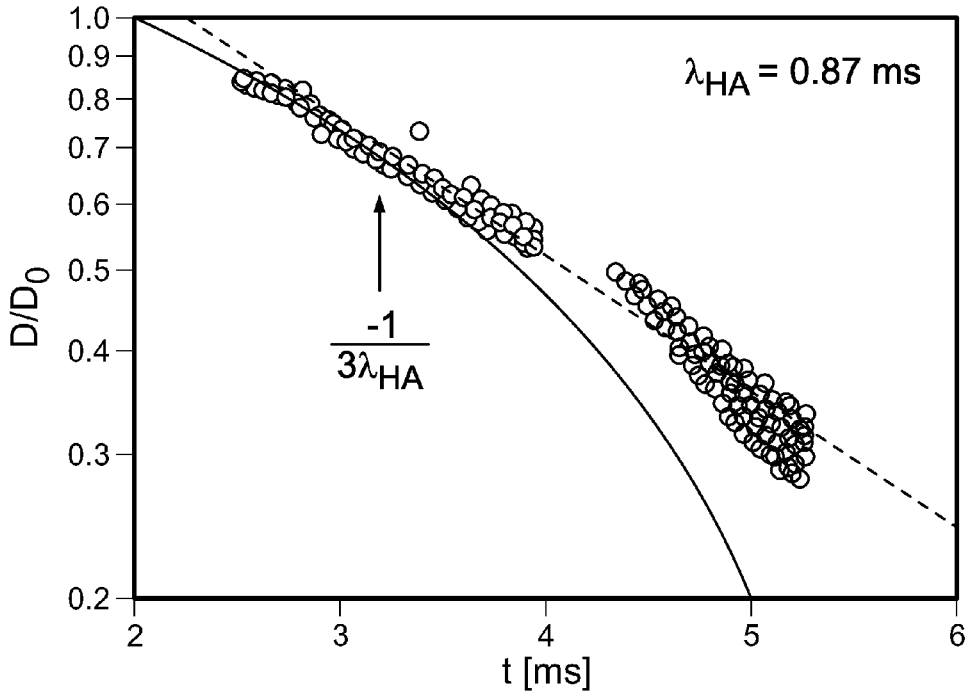
FIG. 6 is a plot showing relaxation time measurement of a fluid that includes a drag-reducing polymer.
Figure 7:
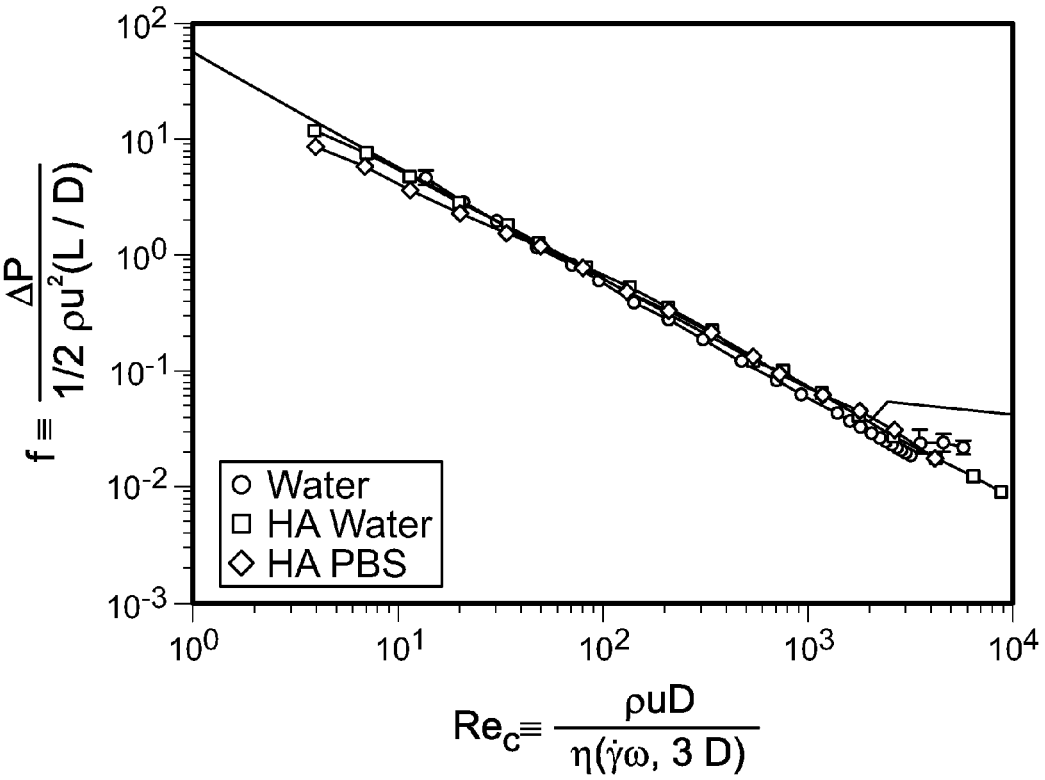
FIG. 7 is a plot showing fanning friction factor in a microchannel for Newtonian and viscoelastic fluids.

FIG. 6 shows the relaxation time measurement of HA solution. The plot shown in FIG. 6 shows diameter D(t) of a thinning HA ($M_w$=1650 kDa) filament bridge as a function of time t. The dashed line in the figure indicates the initial slope from jetting experiments used to calculate the effective relaxation time. The solid line indicates the visco-capillary break up profile of a Newtonian liquid. The relaxation time λ of the native HA solution was measured based on thinning dynamics in jetting experiments. As a viscoelastic liquid bridge thins, the diameter of the filament D will decay according to the relation shown in Equation 4.

$$\frac{D}{D_0} \propto e^{-t/3\lambda} \tag{4}$$

In Equation 4, $D_o$ is the initial diameter of the filament. When plotted on semi-logarithmic axes, the initial slope of filament decay is equal to −1/3λ (FIG. 6). The relaxation time was determined to be λ=8.7×10$^{-4}$ s.

Pressure Drop Measurements

Fluid flow through the microchannel was achieved using a syringe pump (100DX, Teledyne Isco) capable of a maximum volumetric flow rate of 50 ml·min$^{-1}$, a maximum pressure of 10000 PSI, and a maximum capacity of 103 ml. A stainless steel ferrule adapter (Swagelok) connected the syringe pump to the PEEK tubing embedded in the epoxy chip. The syringe pump's internal pressure transducer was used to obtain pressure drop measurements across the entire fluidic circuit. However, we found that the hydrodynamic resistance of the microchannel accounted for approximately 99% of the overall hydrodynamic resistance. As a result, we considered the pressure drop measured by the syringe pump to be essentially equal to the pressure drop along the microchannel.

The pressure drop ΔP was an essential parameter in determining the Fanning friction factor f, defined for laminar flow of a Newtonian fluid through a square microchannel as shown in Equation 5.

$$f = \frac{\Delta P}{0.5\rho U^2(L/D)} = \frac{96}{(1+\alpha)^2}\left[1 - \frac{192}{\pi^5}\alpha\sum_{j=odd}^{\infty}\frac{\tanh(j\pi/2\alpha)}{j^5}\right]^{-1}\frac{1}{Re_c} = \frac{56.9}{Re_c} \tag{5}$$

In Equation 5, U is the mean fluid velocity in the channel, L is the channel length, D is the channel hydraulic diameter, and $Re_c$ is the channel Reynolds number. In this operating regime, ΔP increased linearly with Q, and f scaled inversely with $Re_c$. For $Re_c$>2000 (where the channel flow is expected to be turbulent), f can be expressed in a microchannel as shown in Equation 6.

$$f = \left[-1.8\ln\left(\frac{6.9}{Re_c}\right) + \left(\frac{\varepsilon}{3.7}\right)^{1.11}\right]^{-2} \tag{6}$$

In Equation 6, where ε=k/D is the ratio of the average surface roughness on the channel wall k to the channel hydraulic diameter D. The typical surface roughness was k~O(1 μm) for the epoxy channels described here. This ration was set as ε~0.01 to calculate $f$ as a function of $Re_c$. The characteristic viscosity was an essential parameter for determining the channel Reynolds number, and the Carreau model was used to calculate the characteristic viscosity as a function of wall shear rate.

For Newtonian flow in a square microchannel (i.e., α=1), the analytical solution of wall shear rate $\dot{\gamma}_{w,3D}$ can be expressed as shown in Equation 7.

$$\dot{\gamma}_{w,3D} = \frac{U}{D}\frac{96}{\pi^2(1+\alpha)}\left[\sum_{j=odd}^{\infty}\frac{1-\frac{1}{\cosh(j\pi/2\alpha)}}{j^2}\right]\left[1-\frac{192}{\pi^2}\alpha\sum_{j=odd}^{\infty}\frac{\tanh(j\pi/2\alpha)}{j^5}\right]^{-1} = 9.4\frac{U}{D} \tag{7}$$

FIG. 6 shows the fanning friction factor in the microchannel for Newtonian and viscoelastic fluids. Fanning friction factor $f$ as a function of channel Reynolds number $Re_c$ is determined based on a shear rate-dependent viscosity evaluated at the characteristic shear rate at the wall of a microchannel with square cross-section. The solid line indicates the theoretical friction factor for a Newtonian fluid. When the characteristic viscosity (based on wall shear rate) is used to calculate $Re_c$, the friction factor of the HA solution $f_{HA}$ collapses onto the expected curve for a Newtonian fluid.

Velocimetry Measurements

Figures 8A, 8B, 8C:
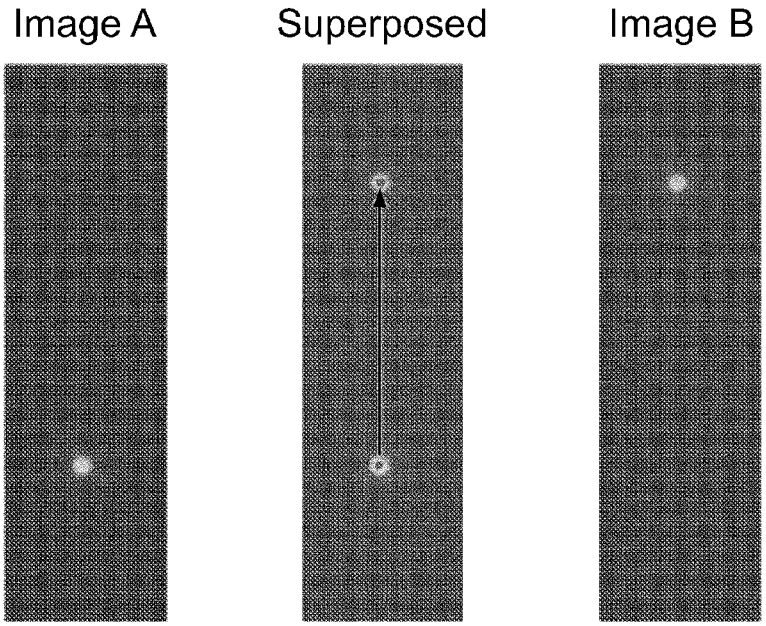
FIGS. 8A-8C are images showing velocimetry measurements of polystyrene beads in Newtonian and viscoelastic fluids.

Images of fluorescent particles in the microchannel were acquired with a double-pulsed 532-nm Nd:YAG laser (LaVision), a 1.4-megapixel CCD camera (PIV-Cam 14-10, TSI), and an epifluorescence microscope (TE-2000, Nikon). Particle velocity measurements were made with 8-μm polystyrene beads ($3\times10^6$ beads·ml$^{-1}$ water or HA solution), and fluid velocity measurements were made with 1-μm polystyrene beads ($3\times10^8$ beads·ml$^{-1}$ water or HA solution). For a given pair of laser pulses, the duration of a single pulse was (δt=10 ns, and the time interval between the two pulses was user-defined depending on the speed of the flow being imaged. At a given x-z plane, particle tracking velocimetry (PTV) was used to record the displacement of 8-μm beads in the x-direction over a given time interval (FIGS. 8A-8C). FIGS. 8A-8C show representative PTV image pair for determining the velocity of individual 8-μm beads in the microchannel at the exposure time of δt=10 ns and a time interval between images of Δt=50 μs.

PTV images were processed in MATLAB (MathWorks) to generate a set of individual particle velocity measurements. At the same x-z plane, micro particle image velocimetry (μ-PIV) was used to record the displacement of 1-μm beads within an array of interrogation windows over a given time interval. For Q<0.1 ml·min$^{-1}$, the particle displacement $2a_p<\Delta x<7.5a_p$ was sufficiently low to enable image analysis using a cross-correlation μ-PIV algorithm (TSI). For Q>0.1 ml·min$^{-1}$, single images that were double-exposed were acquired, and these images were analyzed using an autocorrelation μ-PIV algorithm (LaVision).

Lateral Particle Migration and Equilibrium Position

Figure 9A:
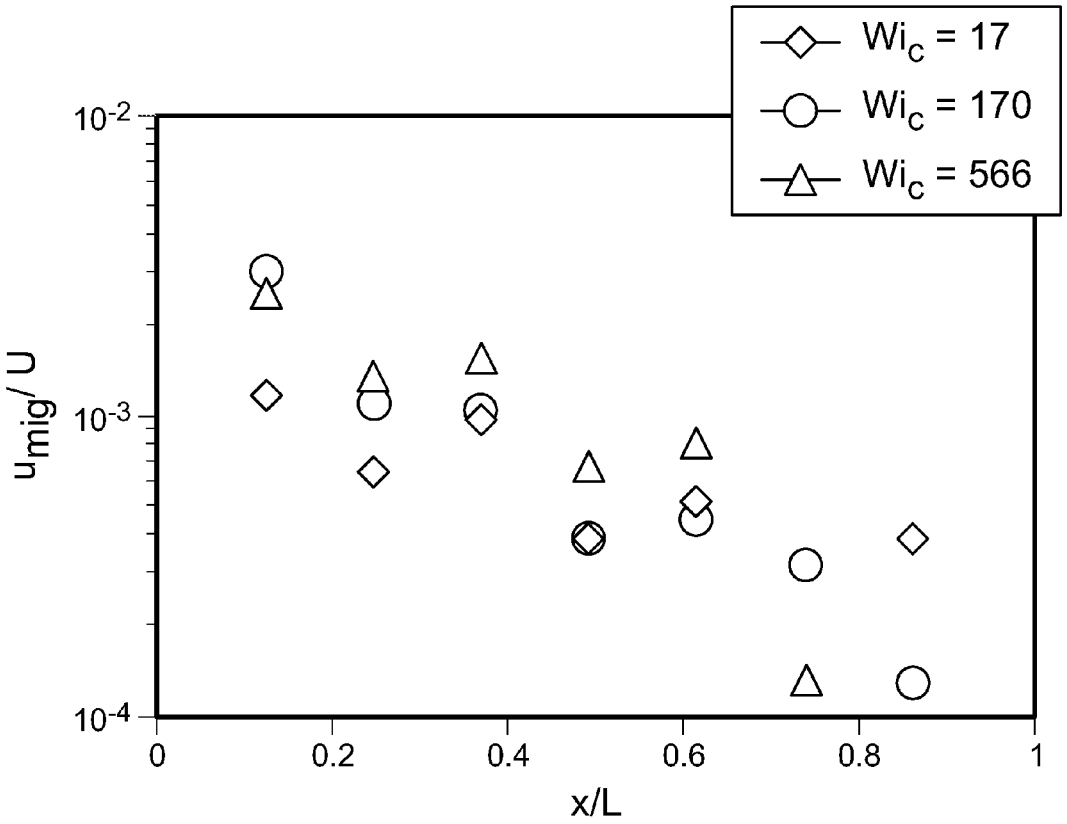
FIGS. 9A and 9B are plots showing particle migration dynamics in a fluid that includes a drag-reducing polymer.
Figure 9B:
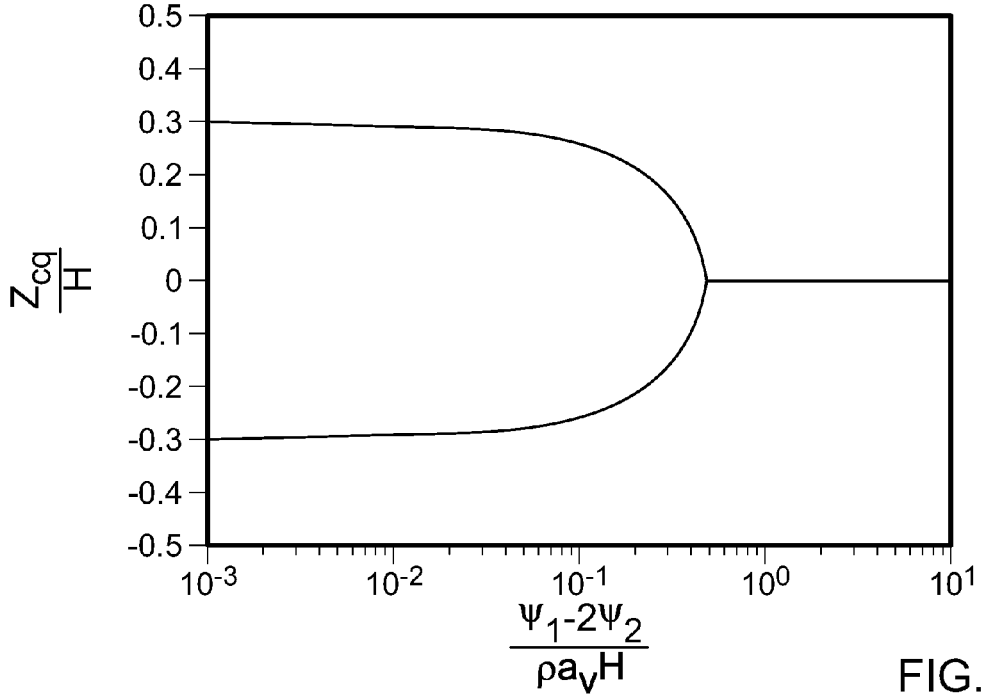

The lateral particle migration was estimated based on the change in the full width at half max (FWHM) of the LEF images captured at Δx=5-mm intervals along the channel length at Q=0.6, 6.0 and 20 ml·min$^{-1}$ The migration velocity is approximately given by $u_{mig}\approx\Delta(FWHM)/2\Delta t$, where Δt=Δx/U and the factor of two in the denominator results from the fact that particles migrate towards the channel centerline from both sides of the channel. FIGS. 9A and 9B show particle migration dynamics in the HA solution. FIG. 9A shows elastically dominated lateral migration velocity of 8 μm particles along the channel length at Q=0.6, 6 and 20 ml·min$^{-1}$ (U=1.6, 16 and 52 m·s$^{-1}$). As shown in FIG. 9A, the values of $u_{mig}$ decreased along the channel length as the particles asymptotically approach the channel centerline (y,z)=(0,0). The ratio of $u_{mig}$/U also increased with Q, indicating that at higher Q the particles can reach their equilibrium position using a shorter channel length.

Inertial migration in a Newtonian liquid in two-dimensional Poiseuille flow has been treated analytically using the method of reflections. The inertial lift force at the position z in the channel is represented by Equation 8.

$$F_L^I = \frac{81}{8}\left(\frac{a_p}{H}\right)^4\rho U^2H^2\left\{\frac{z}{H}\left[2\frac{z}{H}G_1\left(\frac{z}{H}\right)-G_2\left(\frac{z}{H}\right)\right]\right\} \tag{8}$$

In Equation 8, $G_1$ and $G_2$ are functions of z/H that are determined using the Lorentz reciprocal theorem and are evaluated numerically to solve for the resulting lift force. When the net inertial lift force on the particle is zero, the particle equilibrates to a position $z_{eq}$/H=0.3, which is similar to the dimensionless radial equilibrium position for flow in a pipe found experimentally.

Elastic migration in a second order fluid has been studied analytically, and the viscoelastic lift force on a particle is represented by Equation 9.

$$F_L^{VE} = 15\pi\frac{a_p^3}{H}\left(\frac{z}{H}\right)(\Psi_1-2\Psi_2)\left(\frac{U}{H}\right)^2 \tag{9}$$

In Equation 9, $\Psi_1$ and Ψ2 are the first and second normal stress coefficients of the fluid, respectively. For most viscoelastic liquids $\Psi_1>\Psi_2>0$; hence the viscoelastic lift force tends to drive a particle towards the channel centerline (i.e., $z_{eq}$=0). In some implementations, Equation 9 can be simplified by setting $\Psi_1\sim\eta\lambda$ and $\Psi_2$=0.

The equations set forth above can be implemented to determine the competing effects of inertia and viscoelasticity acting simultaneously on the particle equilibrium position. Equating the two forces to determine the equilibrium position of the particle across the channel width results in the implicit Equation 10.

$$2\frac{z_{eq}}{H}G_1\left(\frac{z_{eq}}{H}\right)-G_2\left(\frac{z_{eq}}{H}\right) = \frac{40\pi}{27}\frac{\Psi_1-2\Psi_2}{\rho a_p H} \tag{10}$$

The dimensionless parameter on the right hand side of Equation 10 is a hybrid elasticity number that depends on both the channel dimension H and the particle diameter $a_p$. For values of the elasticity number much less than one, inertia dominates and there are multiple equilibrium positions, whereas particles equilibrate along the channel centerline as the elasticity number is increased above O(1) (FIG. 9B). In FIG. 9B, the dimensionless particle equilibrium position $z_{eq}$/H as a function of the hybrid elasticity number is determined using creeping flow theory. The equilibrium migration behavior is increasingly dominated by elasticity for particles of smaller diameter $a_p$.

Secondary Flow Effects

Figure 10A:
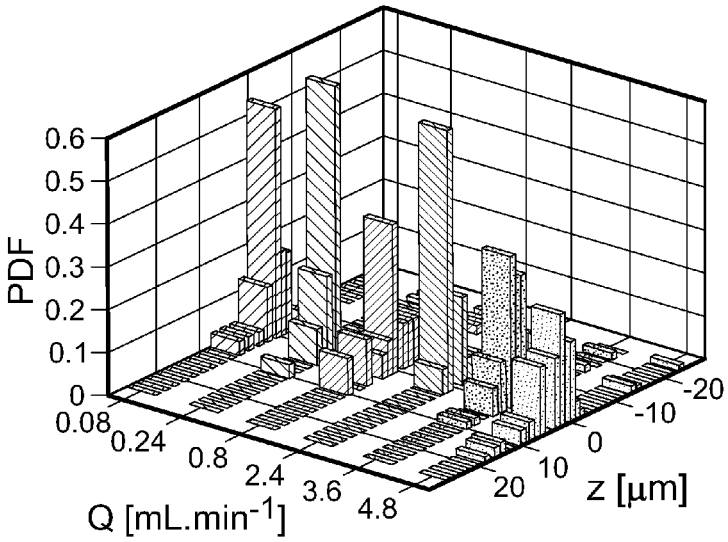
FIGS. 10A-10D show secondary flow effects in a fluid that includes a drag-reducing polymer.
Figure 10B:
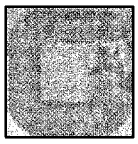
Figure 10C:
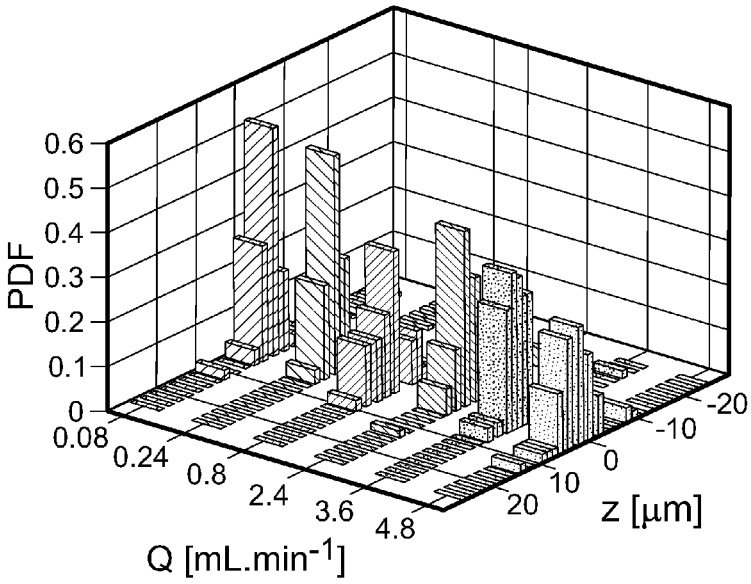
Figure 10D:
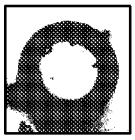

For microchannels with non-axisymmetric cross-section, normal stress differences in a viscoelastic fluid can drive secondary recirculating flows. To observe the effect of secondary flows on particle migration in a viscoelastic fluid, borosilicate glass microchannels with round (axisymmetric) cross-section (FIGS. 10A, 10B) or square (non-axisymmetric) cross-section (FIGS. 10C, 10D) were used. Particle distributions of 8-μm polystyrene beads in HA solution were obtained using PTA for both microchannels. For a range of $Re_c$ corresponding to those studied in the epoxy microchannels, particle focusing toward the channel centerline was observed in both axisymmetric and non-axisymmetric microchannels. At x=35 mm (which was beyond the equilibrium focusing length $L_f$), Gaussian fits to the LEF intensity profiles were indistinguishable to within one particle diameter, indicating that secondary flows did not play a significant role.

Effects of Viscoelastic Normal Stress Differences

For Q=6 ml·min$^{-1}$, one common equilibrium focusing position was observed at the channel centerline for 8-μm polystyrene beads in water and HA solution (FIGS. 11A-11L). These figures are schematic diagrams showing that long-exposure fluorescence (LEF) characterized particle focusing behavior based on aggregate signal intensity of particle populations. Particle trajectory analysis (PTA) characterized particle focusing behavior based on individual particle statistics. The hashed lines indicate the position of the channel walls. At Q=0.6 ml·min$^{-1}$, Re=140 in water, and Re=105 and Wi=17 in HA. At Q=6.0 ml·min$^{-1}$, Re=1400 in water, and Re=1270 and Wi=170 in HA. At Q=20.0 ml·min$^{-1}$, Re=4360 in water, and Re=4422 and Wi=566 in HA.

Figure 12A:
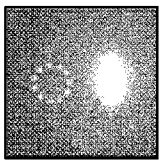
FIGS. 12A and 12B are images show visualizations of viscoelastic normal stress differences between particles suspended in two different fluids.
Figure 12B:
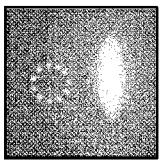

To characterize the importance of normal stress differences in the HA solution, a particle whose response to these effects could be visualized in some manner was identified. The HL-60 cells were selected based on their sphericity and deformability, and fluorescently labeled with Calcein Red-Orange. The shape of individual HL-60 cells occupying the common equilibrium position in the channel center was observed using PTA (FIGS. 12A, 12B). The magnitude of cell stretching was calculated based on the ratio of maximum cell diameter measured along the x-axis to maximum cell diameter measured along the z-axis. For Q=6 ml·min$^{-1}$, a mean aspect ratio of 1.4 was observed for HL-60 cells in PBS and 2.8 for HL-60 cells in HA solution. For Q=13 ml·min$^{-1}$, single-stream focusing of HL-60 cells was not observed for the two fluids tested, but the limiting factor was different in each case. For HL-60 cells in PBS, the focusing behavior was lost due to onset of turbulence. By contrast, the focusing capacity of HL-60 cells in HA solution appeared to diminish due to a combination of excessive cell stretching and the corresponding reduction in hydraulic diameter of the cells. These results suggest that viscoelastic normal stresses play a critical role in both particle focusing and particle stretching as it relates to deformable particles.

Figure 16:
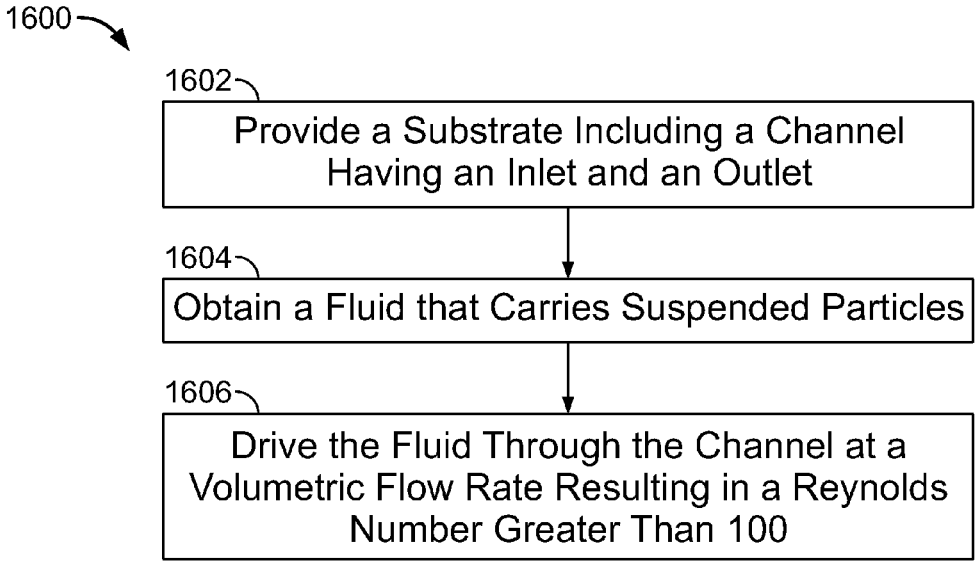
FIG. 16 is a flowchart of an example process for focusing particles suspended within a moving fluid.

FIG. 16 is a flowchart of an example process 1600 for focusing particles suspended within a moving fluid. At 1602, a substrate including a channel having an inlet and an outlet, such as the substrate described above, is provided. At 1604, a fluid that carries suspended particles, such as the particles described above, is obtained. At 1606, the fluid is driven through the channel at a volumetric flow rate resulting in a Reynolds number greater than 100.

EXAMPLES

The following examples illustrate, but do not limit the scope of the invention described in the claims.

Example 1—Preparing a Microfluidic Device

Figure 13A:
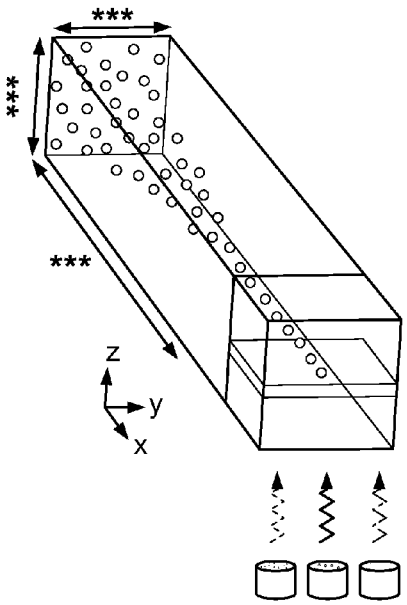
FIG. 13A is a schematic diagram that shows particle focusing in a channel having a substantially square cross-section.
Figure 13B:
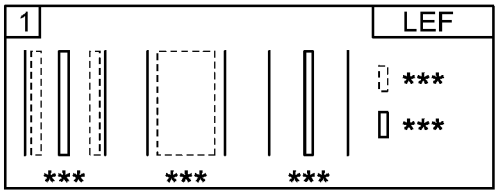
FIG. 13B is an image that shows long exposure fluorescence (LEF) images of particles flowed through the channel at different Reynolds numbers and Weissenberg numbers.
Figure 13C:
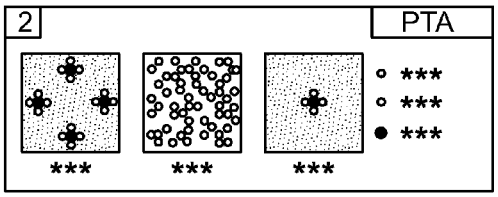
FIG. 13C is an image that shows particle trajectory analysis (PTA) images of particles flowed through the channel at different Reynolds numbers and Weissenberg numbers.
Figure 13D:
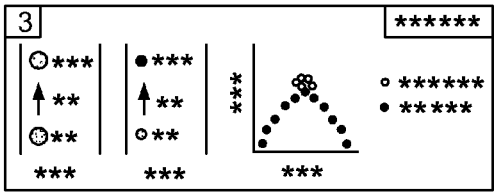
FIG. 13D is an image that shows particle tracking velocimetry (PTV) images of particles of different hydraulic diameters.

An epoxy-based fabrication technique was used to construct a 35-mm long straight channel with H=80±5 μm square cross-section (FIG. 13A) capable of achieving a maximum throughput of Q=50 ml·min$^{-1}$ (Re=10,400, U=130 m·s$^{-1}$). For the construction of the epoxy device, channel features were created using the computer-aided design software, AutoCAD, and printed on a Mylar™ mask (e.g., from FineLine Imaging). SU-8 photoresist (e.g., from MicroChem) was deposited onto a silicon wafer to produce a master consisting of straight channels (e.g., L=35 mm) with square (H=80±5 μm) cross-section. A polydimethylsiloxane (PDMS) elastomer (e.g., Sylgard 184, Dow Corning), was poured over the master to generate an elastomer replica. The replica was peeled off and coated with a silane agent such as (tridecafluoro-1,1,2,2-tetrahydrooctyl)trichlorosilane (e.g., from Gelest) to produce a hydrophilic surface. The elastomer was poured over the silane-coated replica to generate a hydrophobic master.

The master was peeled off and punched with inlet and outlet holes using a coring tool (e.g., Harris Uni-Core). One end of a 7-mm strand of Teflon cord (McMaster-Carr) was partially inserted into tubing, e.g., a 13-inch strand of PEEK tubing (Sigma-Aldrich). The other end of the cord was partially inserted into the inlet and outlet holes of the master (FIG. 3I). Epoxy resin (EpoxAcast 690, Smooth-On) was poured over the PDMS master to generate an epoxy replica. After curing, the epoxy replica was separated from the flexible master, and the plugs were removed from the inlet and outlet holes. A substrate, e.g., a 1-inch by 3-inch glass slide (Thermo Scientific), is coated with resin, e.g., a 200-μm thick layer of epoxy resin. The epoxy replica and epoxy-coated glass slide are bonded, e.g., irreversibly, e.g., using mild (50° C.) heat from a hot plate (Thermo Scientific) and gentle pressure using tweezers (Techni-Tool). For the construction of glass devices, borosilicate glass tubing (VitroCom) with round (50-μm diameter) or square (50-μm height and width) cross-section can be used. Tubing, e.g., PEEK or Tygon tubing can be bonded to a glass slide using an epoxy liquid (Loctite). Each end of the borosilicate glass tubing can be inserted into PEEK or Tygon tubing using an epoxy gel (Loctite). The edges of the glass slide can be covered with air-dry clay (Crayola), and the borosilicate glass tubing can be submerged in an optically matched fluid (Sigma-Aldrich).

Example 2—Preparing Samples for Testing Fluid Flows Through a Microfluidic Device Hyaluronic acid (HA) sodium salt (Sigma-Aldrich or Lifecore Biomedical) was added to water (Sigma-Aldrich) for bead suspensions or phosphate buffered saline (PBS) solution (Life Technologies) solution for cell suspensions and prepared using a roller mixer (Stuart, Sigma-Aldrich). Polystyrene beads (FluoSpheres, Invitrogen or Fluoro-Max, Thermo Scientific) suspended in Tween-20 (Sigma-Aldrich) solution (0.1% v/v in water) were diluted in HA solution (1650 kDa, 0.1% w/v in water) at a concentration of $3\times10^6$ beads/ml.

Human leukemia cell lines (HL-60, ATCC) were suspended in Iscove's Modified Dulbecco's Medium (ATCC)

containing 20% FBS (Gibco) and incubated at 37° C. and 5% $CO_2$. HL-60 cells were centrifuged and suspended in Calcein Red-Orange (Invitrogen) solution (2 μg/ml in PBS). Fluorescently labeled HL-60 cells were centrifuged and suspended in PBS or HA solution (1650 kDa, 0.1% w/v in PBS) at a concentration of $1\times10^6$ cells/ml.

White blood cells (WBCs) were harvested from human Buffy coat samples (MGH Blood Bank) via density gradient centrifugation (Histopaque-1077, Sigma-Aldrich). WBCs were centrifuged and suspended in Calcein Red-Orange solution (10 μg/ml in PBS). Fluorescently labeled WBCs were centrifuged and suspended in PBS, low molecular weight HA solution (357 kDa, 0.1% w/v in PBS) or high molecular weight HA solution (1650 kDa, 0.1% w/v in PBS) at a concentration of $5\times10^6$ cells/ml.

Anisotropic (cylindrical) hydrogel particles were synthesized via stop-flow lithography from pre-polymer solutions of 60% poly(ethylene glycol) diacrylate (PEG-DA 700, Sigma-Aldrich), 30% poly(ethylene glycol) (PEG 200, Sigma-Aldrich), 10% 2-hydroxy-2-methylpropiophenon (Sigma-Aldrich), and 3 mg/ml rhodamine acrylate (Polysciences). Fluorescently labeled PEG particles (20-μm length, 10-μm cross-sectional diameter) were collected and washed in Tween-20 solution (0.1% v/v in PBS) prior to dilution in HA solution (1650 kDa, 0.1% w/v in water).

Example 3—Imaging Particles Flowed in Test Fluids Flows Through a Microfluidic Device Fluids carrying particles (described below) were infused into the microchannel described in Example 1 using a high-pressure (10,000 PSI), high-throughput (50 ml/min) syringe pump to flow the fluids through the microchannel. Long-exposure fluorescence (LEF) imaging was used to efficiently detect particle migration based on aggregate signal intensity (FIGS. 13A-13D). Particle trajectory analysis (PTA) was used to observe specific features (e.g., 3D position, orientation, and deformation) of the particle migration based on individual particle statistics. Microparticle imaging velocimetry (μ-PIV) was used to measure the local fluid velocity in the microchannel (based on 1-μm polystyrene beads), while particle tracking velocimetry (PTV) was used to measure discrete particle velocities in the microchannel (based on 8-μm polystyrene beads).

Figure 13E:
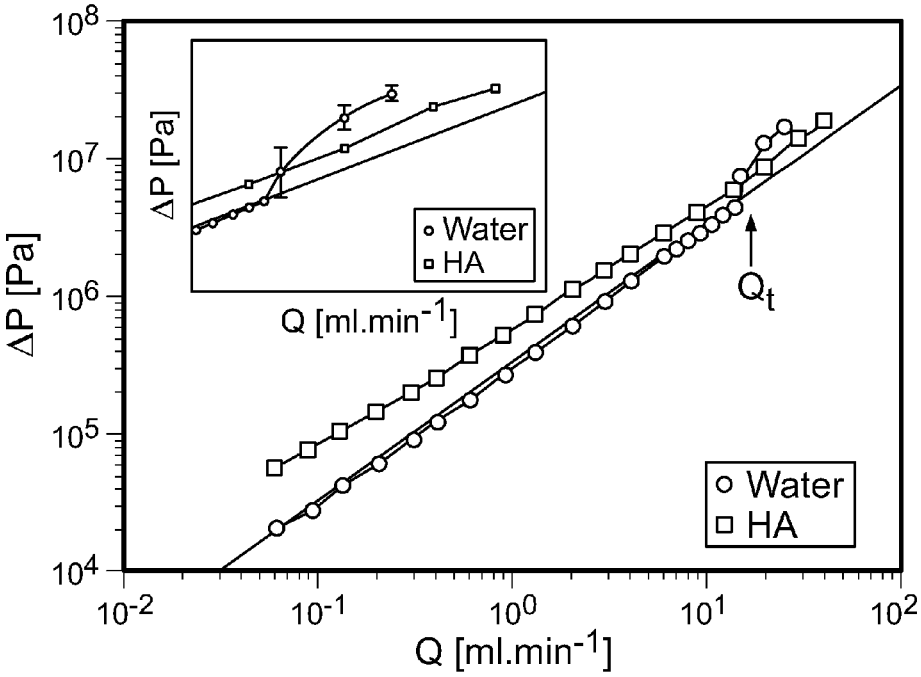
FIG. 13E is a plot comparing pressure drops versus volumetric flow rates across the channel for water and a fluid including hyaluronic acid.
Figure 13F:
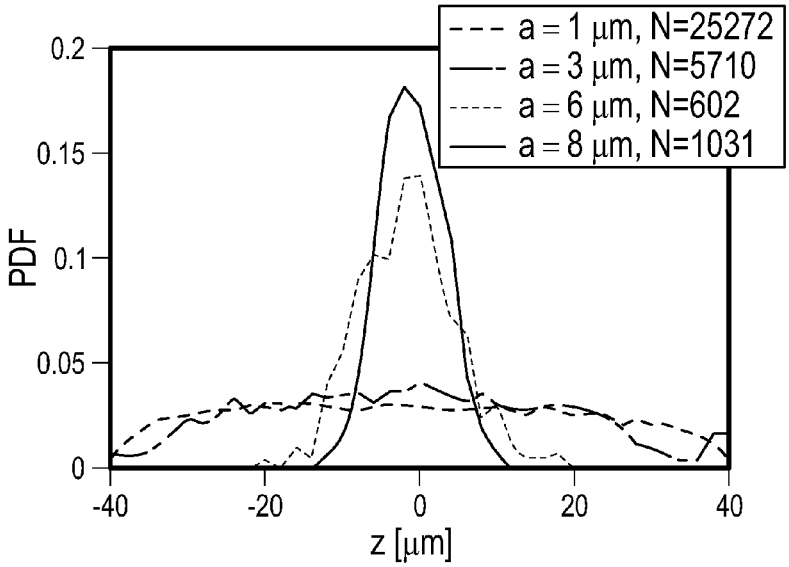
FIG. 13F is a plot of a probability density function determined from N particles sized from $a_p$=1, 3, 6 and 8 μm (volume fraction $\phi$=2.0% for 1 μm and $\phi$=0.05% for 3, 6 and 8 μm) across the channel width determined from short exposure images with pulsed laser illumination.
Figure 13G:
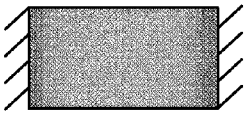
FIGS. 13G-13J are images showing particles sized from $a_p$=1, 3, 6 and 8 μm (volume fraction $\phi$=2.0% for 1 μm and $\phi$=0.05% for 3, 6 and 8 μm) across the channel width.
Figure 13H:
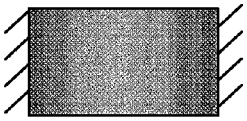
Figure 13I:
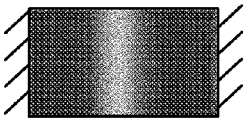
Figure 13J:
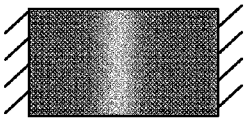

Example 4—Comparing Particle Migration in Fluids with and Without a Viscoelastic Additive To study particle migration in viscoelastic flows at high Reynolds number, HA was selected as a model viscoelastic additive based on its biocompatibility and the turbulent drag-reducing properties in the flow of blood and synovial fluid. The Reynolds number was calculated based on a shear-rate dependent viscosity as defined by the Carreau model described above. This viscosity was evaluated at the relevant wall shear rate in the fluid $\dot{\gamma}$=9.4 U/H, based on the analytical solution for the velocity field of a Newtonian liquid in a square channel (with cross-sectional dimension H). The Weissenberg number was calculated based on a fluid relaxation time $\lambda=8.7\times10^{-4}$ s measured experimentally using the thinning dynamics of a liquid filament. The measured pressure drop ΔP over the entire fluidic network was measured by the syringe pump for a given imposed flow rate Q (FIG. 13E). FIG. 13E is a plot comparing pressure drops versus volumetric flow rates across the channel for water and a fluid including hyaluronic acid, which shows lateral migration of the particles towards the centerline.

For water, $\Delta P_{water}$ water first increased linearly with Q before increasing more rapidly at Re≈2500±500, which indicated a transition to turbulence. In the HA solution, $\Delta P_{HA}$ scaled sublinearly with Q due to shear-thinning effects, and $\Delta P_{HA}>\Delta P_{water}$ (due to the higher fluid viscosity) for $Q<Q_t$, where $Q_t\approx12\pm2.5$ ml·min$^{-1}$ is the flow rate at which the flow of water transitioned from laminar to turbulent. However, for flow rates $Q>Q_t$, $\Delta P_{HA}$ continued to scale sublinearly with Q (up to 50 ml·min$^{-1}$), which suggests that the flow of the HA solution remained laminar even up to Re≈10,000. Using a microfluidic rheometer, the viscosity of the HA solution ($M_w$=1650 kDa, 0.1% w/v) was measured before and after sample processing within the range of shear rates explored in the microchannel ($10^3<\dot{\gamma}<10^7$ s$^{-1}$). The shear viscosities of the native and used samples were found to remain almost unchanged, indicating that shear-induced degradation of the sample was not a major issue.

Figure 11A:
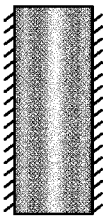
FIGS. 11A-11L are images that show particle migration behavior in a Newtonian fluid and in a fluid with varying dynamic viscosity.
Figure 11C:
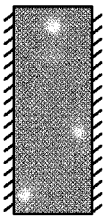
Figure 11E:
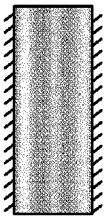
Figure 11G:
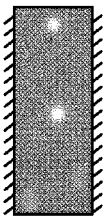
Figure 11B:
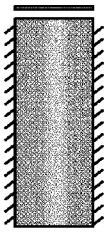
Figure 11D:
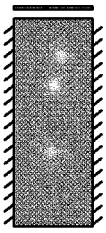

Example 5—Comparing Particle Migration at Flow Rates that Correspond to Laminar Flow Regimes With the ability to achieve laminar microchannel flow at Reynolds number up to Re≈10,000 in a viscoelastic HA solution, the effect of persistent laminar flow conditions on inertio-elastic particle focusing was studied. To do so, first, 8-μm in HA were flowed through the microfluidic channel at a volumetric flow rate, Q, of 0.6 ml·min⁻1 FIGS. 11B and 11D show long exposure fluorescence and particle trajectory analysis (PTA) images, respectively, of the viscoelastic HA solution flowed through the microchannel at the volumetric flow rate, Q, of 0.6 ml·min$^{-1}$ The images show that, at Q=0.6 ml·min$^{-1}$ (Re=105, Wi=17), particle migration towards a single centralized point along the channel centerline was observed.

Figure 11F:
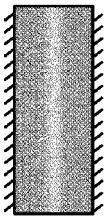
Figure 11H:
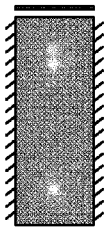

Then, the viscoelastic HA solution was flowed through the microchannel at a volumetric flow rate, Q, of 6 ml·min⁻1 FIGS. 11F and 11H, which are LEF and PTA images, respectively, of the viscoelastic HA solution flowed through the microchannel, show focusing behavior in HA solution at the flow rates as high as Q=6 ml·min$^{-1}$ (Re=1270, Wi=170).

Figure 11I:
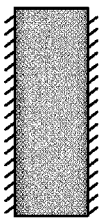
Figure 11K:
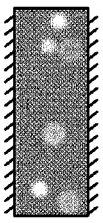
Figure 11J:
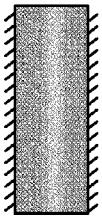
Figure 11L:
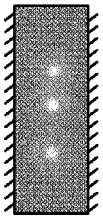

Further, the viscoelastic HA solution was flowed through the microchannel at a volumetric flow rate, Q, of 20 ml·min$^{-1}$ FIGS. 11J and 11L, which show LEF and PTA images, respectively, of the viscoelastic HA solution flowed through the microchannel at the volumetric flow rate, Q, of 20 ml·min$^{-1}$ (Re=4422, Wi=566), show that particles in the HA solution focused toward the microchannel center at these flow rates.

The results obtained in the viscoelastic HA solution were in stark contrast to those in a Newtonian fluid, e.g., water. FIGS. 11A and 11C show LEF and PTA images, respectively, of water flowed through the microchannel at a volumetric flow rate, Q, of 0.6 ml·min$^{-1}$ FIGS. 11E and 11G show LEF and PTA images, respectively, of water flowed through the microchannel at a volumetric flow rate, Q, of 6 ml·min$^{-1}$. In water, beads initially focused to four off-center equilibrium positions near each face of the rectangular microchannel at Q=0.6 ml·min$^{-1}$ (Re=140) before shifting to a five-point quincunx configuration at Q=6 ml min$^{-1}$ (Re=1400) with equilibrium positions at the centerline and the four channel corners, where the shear rate is lowest. These experimental observations in water were in broad agreement with previous numerical studies of inertial migration in Newtonian fluids.

Example 6—Comparing Particle Migration at Flow Rates that Correspond to Above-Laminar Flow Regimes In this example, the fluid was flowed through the microfluidic channel at flow rates of $Q>Q_t$. Having established that particle focusing can be achieved for $Q<Q_t$ in both water and HA solution, albeit with significant configurational differences, $Q>Q_t$ was set to determine if deterministic particle focusing could be preserved in either fluid. For $Q>13$ ml $min^{-1}$ in water (Re>2000), particle tracking showed that the fluorescent beads were randomly distributed throughout the channel due to the onset of inertial turbulence, and this critical flow rate corresponded closely to the critical conditions beyond which $\Delta P_{water}$ increased superlinearly with increasing Q. Surprisingly, for $Q>Q_t$, beads in the HA solution continued to focus towards a centralized point along the channel centerline. Also, it was found that particle focusing in HA solution persisted to Reynolds numbers well above the upper limit for particle focusing in water. These results represent the highest flow rates at which deterministic particle focusing has been achieved in a microchannel, and illustrate the precise focusing control that can be achieved by using only small amounts of a viscoelastic drag-reducing polymeric agent (HA).

FIGS. 11I and 11K show LEF and PTA images, respectively, of water flowed through the microchannel at a volumetric flow rate, Q, of 20 ml·$min^{-1}$ (Re=4360). The images show that the particles in water are no longer focused at high Reynolds numbers.

Figure 13K:
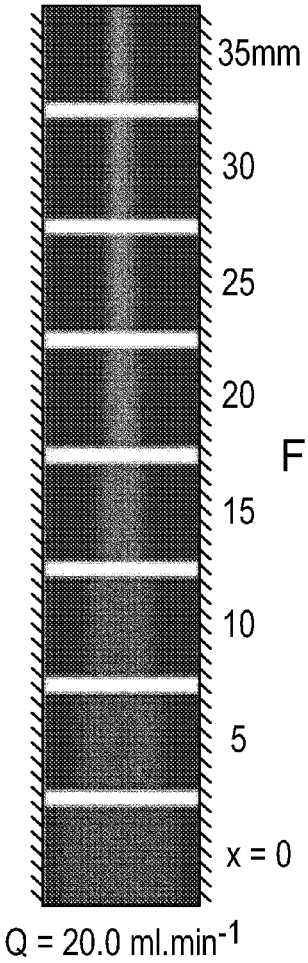
FIG. 13K shows LEF images of 8-μm particles at 5-mm intervals along the length of the channel at Q=20 ml·min−1, showing the lateral migration of the particles towards the centerline.

Example 7—Analyzing the Effect of Particle Size on Inertio-Elastic Particle Focusing Given the well-known dependence of focusing efficiency on particle diameter $a_p$ for inertial focusing, and creeping flows of viscoelastic fluids, the effect of particle size on the inertio-elastic particle focusing observed in the HA solution was analyzed. Using polystyrene beads with $a_p$=1, 3, 6, or 8 μm, it was found that particle focusing toward the channel center in HA solution improved with increasing particle size at Q=20 ml·$min^{-1}$ (FIGS. 13F-13J, Re=4422, Wi=566). Theoretical analysis of a single particle in the creeping flow limit shows that the elastic lift force on a spherical particle in a weakly elastic fluid undergoing a pressure-driven shear flow scales as $F_{L,E}\sim\eta\lambda U^2(a_p/H)^3$. By contrast, the lateral resistive Stokes drag that resists particle migration only scales linearly with particle size $a_p$ and with the migration velocity $u_{mig}$. Hence, the value of $u_{mig}$ is expected to scale strongly with $a_p$, meaning that a larger particle should require a much shorter distance to reach its equilibrium position. Using LEF images captured along the entire length of the microchannel at Q=20 ml·$min^{-1}$ (FIG. 13K), it was found that 8-μm beads laterally migrated to their equilibrium position within an equilibrium focusing length $L_f\leq30$ mm, based on the unchanged width of the focused streak further downstream. By contrast, at the same flow rate, lateral migration of 6-μm beads was incomplete within the channel length L=35 mm.

Figure 14A:
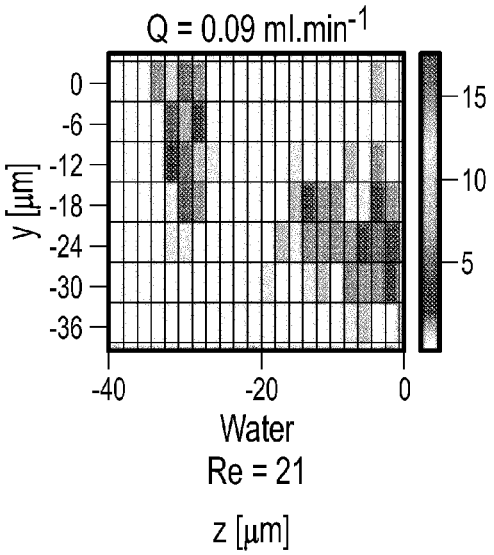
FIGS. 14A and 14B show cross-sectional particle histogram of 8-μm particles in water and hyaluronic acid, respectively, in a lower quadrant of the square cross-section channel at Q=0.09 ml·min$^{-1-}$.
Figure 14B:
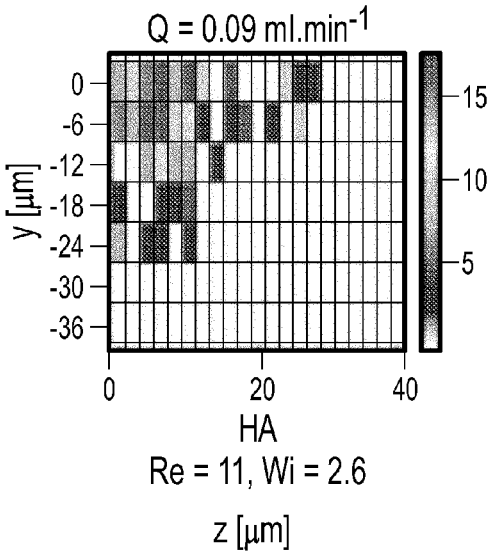
Figure 14C:
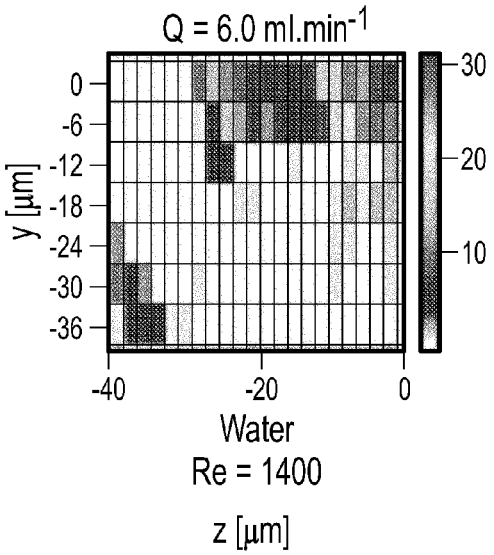
FIGS. 14C and 14D show cross-sectional particle histogram of 8-μm particles in water and hyaluronic acid, respectively, in a lower quadrant of the square cross-section channel at Q=6.0 ml·min$^{-1-}$.
Figure 14D:
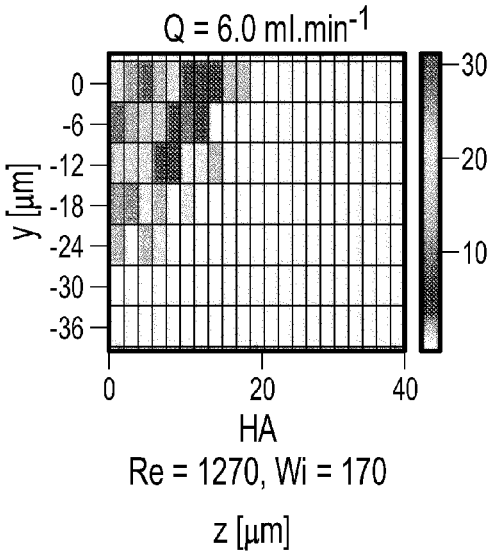
Figure 14E:
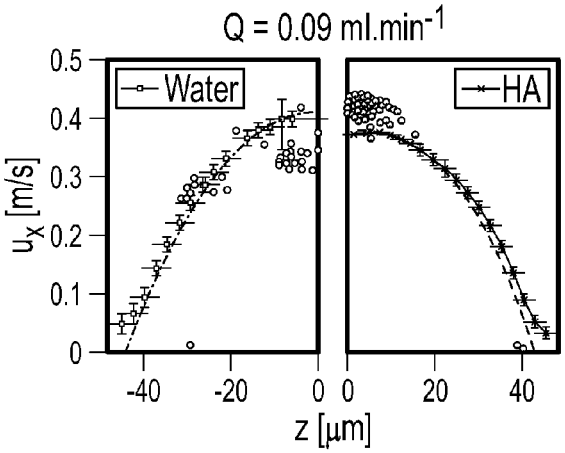
FIG. 14E shows velocity profiles measured in water and hyaluronic acid, respectively, and the corresponding velocities of the migrating 8-μm beads (black dots for beads in water and violet dots for beads in the HA solution) measured at the channel mid-plane (y=0 μm) at Q=0.09 ml·min$^{-1}$.
Figure 14F:
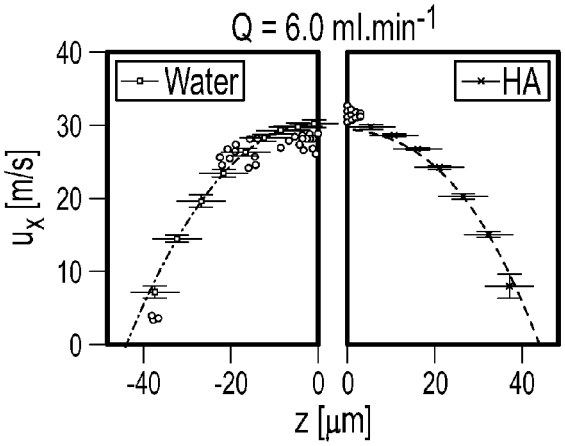
FIG. 14F shows velocity profiles measured in water and hyaluronic acid, respectively, and the corresponding velocities of the migrating 8-μm beads (black dots for beads in water and violet dots for beads in the HA solution) measured at the channel mid-plane (y=0 μm) at Q=6.0 ml·min$^{-1}$.

Example 8—Studying the Physical Basis of Inertio-Elastic Particle Focusing in the HA Solution To provide further insight into the physical basis of inertio-elastic particle focusing in the HA solution, a comparative study of water and HA solution within the laminar regime was performed. For a given flow rate, vector plots of fluid velocity were constructed based on 1-μm neutrally-buoyant beads being convected with the fluid through the microchannel. In addition, "heat maps" of particle occurrence frequency across the channel cross-section were constructed based on the 2D position of 8-μm beads moving through the microchannel (FIGS. 14A, 14B). Then, the velocity profiles were combined with the individual particle statistics (FIGS. 14C, 14D). First, the effect of shear-thinning on particle focusing in HA solution was considered. This was motivated by previous work suggesting that shear-thinning in the fluid viscosity drives particles toward the wall. At Q=0.09 ml·$min^{-1}$, a markedly more blunt fluid velocity profile in the HA solution compared to water was observed (FIGS. 14E, 14F), which is consistent with shear-thinning behavior observed at $\dot{\gamma}\sim O(10^4)$ $s^{-1}$ (FIG. 5) and with computational simulations using the Carreau model. At Q=6 ml·$min^{-1}$, the characteristic shear rate in the fluid increased to $\dot{\gamma}\sim O(10^6)$ $s^{-1}$ where the viscosity varied less strongly with shear rate. Continued particle focusing towards the center in the HA solution was observed despite nearly identical fluid velocity profiles (measured using μ-PIV with 1-μm beads) for water and the HA solution (FIGS. 14E, 14F). This result suggests that shear-thinning in the velocity profile did not play a dominant role in particle focusing under these flow conditions.

One important difference between the measured velocity profiles in water and the HA solution is the relationship between the average fluid velocity $u_f$ and the corresponding particle velocity $u_p$ once the focusing has fully developed (i.e., $x>L_f$) (FIGS. 14E, 14F). At each flow rate, the measured centerline velocity of the 8-μm beads in the HA solution was found to be faster than the local fluid velocity. For example, at Q=6.0 ml·$min^{-1}$ the measured velocity of the beads was $u_p$=30.9±0.7 m·$s^{-1}$ in the HA solution compared to a local fluid velocity of $u_f$=30.2 m·$s^{-1}$ (FIG. 14E, 14F). By contrast, in water, the particles along the centerline translated at $u_p$=28.2±0.9 m·$s^{-1}$, which was slower than the local fluid velocity. These trends are consistent with (i) a drag increase expected for a sphere moving in a Newtonian channel flow, given by Faxén's law for creeping flow and an Oseen correction for fluid inertia, as well as (ii) the viscoelastic drag decrease on a sphere that is initially expected at a moderate particle Weissenberg number.

The effect of secondary flows on particle focusing in HA solution was also studied. This was motivated by recent work showing that in channels with non-axisymmetric cross-section, normal stress differences in a viscoelastic fluid can drive secondary recirculating flows that are superposed on top of the primary axial flow field. Comparing the migration behavior of 8-μm beads in a 50-μm square (non-axisymmetric) channel and in a corresponding cylindrical (axisymmetric) tube, particle focusing toward the centerline was observed in both cases. Gaussian fits to the LEF intensity profiles observed at $x>L_f$ were indistinguishable to within one particle diameter as described above with reference to FIGS. 10A-10D, indicating that secondary flows did not play a significant role.

The effect of viscoelastic normal stress differences on particle focusing in HA solution was considered. Early theoretical work in the creeping flow limit has shown that particle migration in the direction of minimum shear rate (i.e., towards the channel centerline) is induced by gradients in the normal stress differences that are present when the shear rate in the fluid varies laterally in the undisturbed flow field around the particle. Numerical simulations of particle sedimentation in quiescent viscoelastic fluids have also demonstrated that viscoelastic stresses drive particles towards the centerline of channels and tubes, and μ-PIV experiments have shown that fluid viscoelasticity can dramatically change the local velocity field around a particle near a wall. Fully developed numerical simulations of inertio-elastic particle migration are only just beginning to become feasible (and are presently limited to moderate Weissenberg numbers (Wi<50) and Reynolds numbers (Re<40)) but having eliminated shear-thinning and secondary flows as primary drivers of this centerline focusing it is clear that the role of viscoelastic normal stresses cannot be neglected.

Figure 15A:
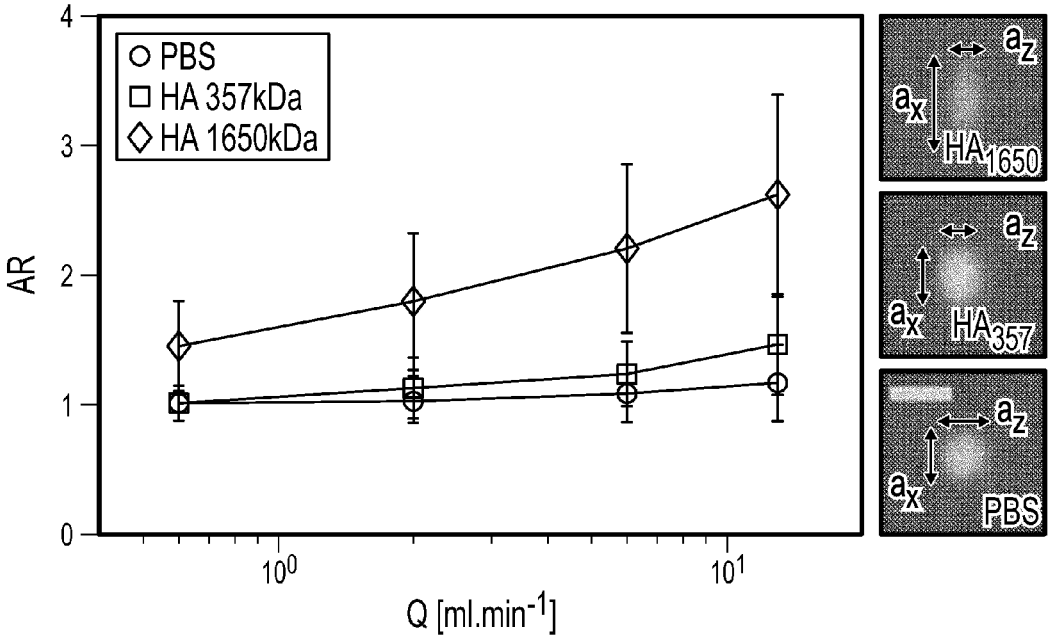
FIG. 15A is a graph that shows deformation characteristics of white blood cells in PBS, a low molecular weight (357 kDa) HA solution and a high molecular weight (1650 kDa) HA solution.
Figure 15B:
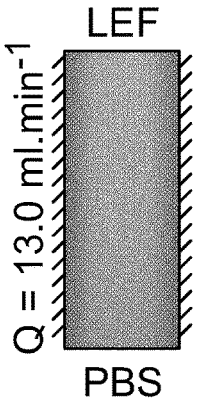
FIGS. 15B to 15G are long exposure fluorescence and particle trajectory analysis images of white blood cells in PBS, 357 kDa HA solution and 1650 kDa HA solution at Q=13 ml·min$^{-1}$.
Figure 15C:
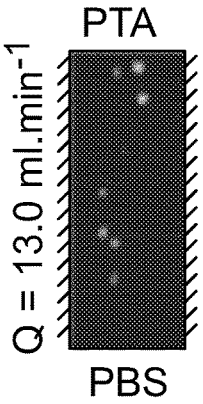
Figure 15D:
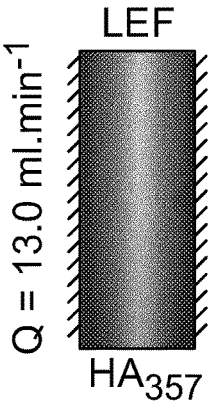
Figure 15E:
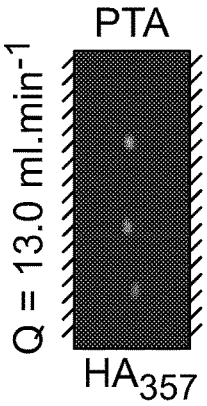
Figure 15F:
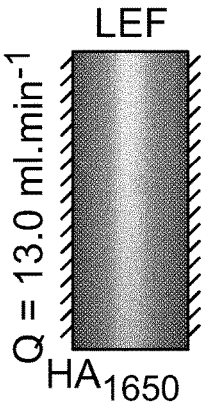
Figure 15G:
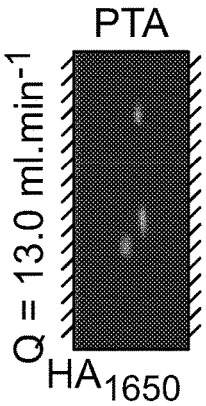

Example 9—Studying the Effect of HA on Inertio-Elastic Focusing of Human White Blood Cells The deformability of human white blood cells (WBCs) was used to directly visualize the effects of normal stress differences in the fluid, which create an additional tensile stress along streamlines. Because of the high spatial fidelity and lack of particle blurring induced by the short duration of the pulsed laser imaging (δt=10 ns), it was possible to quantify the distortional effects of this streamline tension on the shape of an individual particle up to shear rates $\dot{\gamma}\sim O(10^6)$ $s^{-1}$. The magnitude of WBC deformation was expressed in terms of a mean aspect ratio $AR=a_x/a_z$ (FIG. 15A). For WBCs suspended in PBS, the aspect ratio monotonically increased from AR=1.0 (at Q=0.6 ml·min$^{-1}$, Re=140) to AR=1.2 (at Q=13 ml·min$^{-1}$, Re=3,033) due to the increasing variation in the magnitude of the viscous shear stress acting across the WBC. By contrast, for WBCs suspended in the 1650 kDa HA solution, the aspect ratio monotonically increased from AR=1.4 (at Q=0.6 ml·min$^{-1}$, Wi=17, Re=105) to AR=2.5 (at Q=13 ml·min$^{-1}$, Wi=368, Re=2,840). However, a breakdown in focusing of these deformable particles was observed in both fluids at higher flow rates. For WBCs in a Newtonian fluid the focusing behavior was lost due to onset of turbulence for $Q>Q_t$. By contrast, the focusing capacity of WBCs in a viscoelastic fluid appeared to diminish due to a combination of excessive cell stretching and the corresponding reduction in the hydraulic diameter of the cells (FIGS. 15B-15G).

Example 10—Studying the Role of Fluid Rheology on Particle Focusing and Particle Stretching The role of fluid rheology in manipulating the interplay of particle focusing and particle stretching was also investigated. To reduce the magnitude of the viscoelastic normal stresses experienced by WBCs, a lower molecular weight (357 kDa) HA solution was used. From the Zimm scaling for dilute polymer solutions ($\lambda\sim M_w^{0.8}$), the relaxation time for this less viscoelastic solution was estimated to be $\lambda_{357\ kDa}\approx 2.6\times10^{-4}$ s, and the Weissenberg number ws reduced to Wi≈100 at Q=13 ml·min$^{-1}$. Pulsed laser images indicate the maximum anisotropy in the cell dimensions was reduced to AR=1.4 and we observed enhanced WBC focusing at flow rates beyond Q=13 ml·min$^{-1}$. These results suggest that by tuning the nonlinear rheological properties of the viscoelastic working fluid it is possible to control both particle focusing and particle deformation.

Figure 15H:
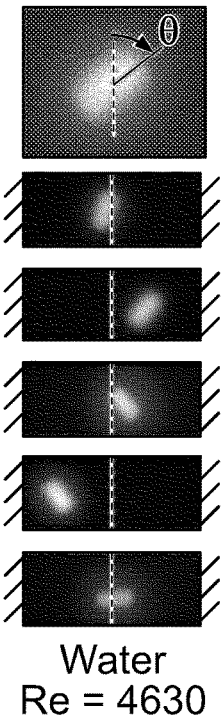
FIGS. 15H and 15I are particle trajectory analysis images of PEG particles in 1650 kDa HA solution at Q=20 ml·min$^{-1}$.
Figure 15I:
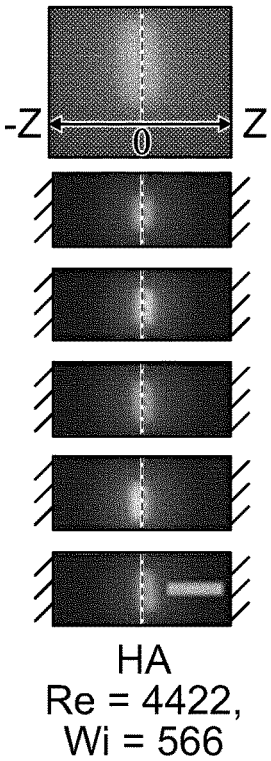
Figure 15J:
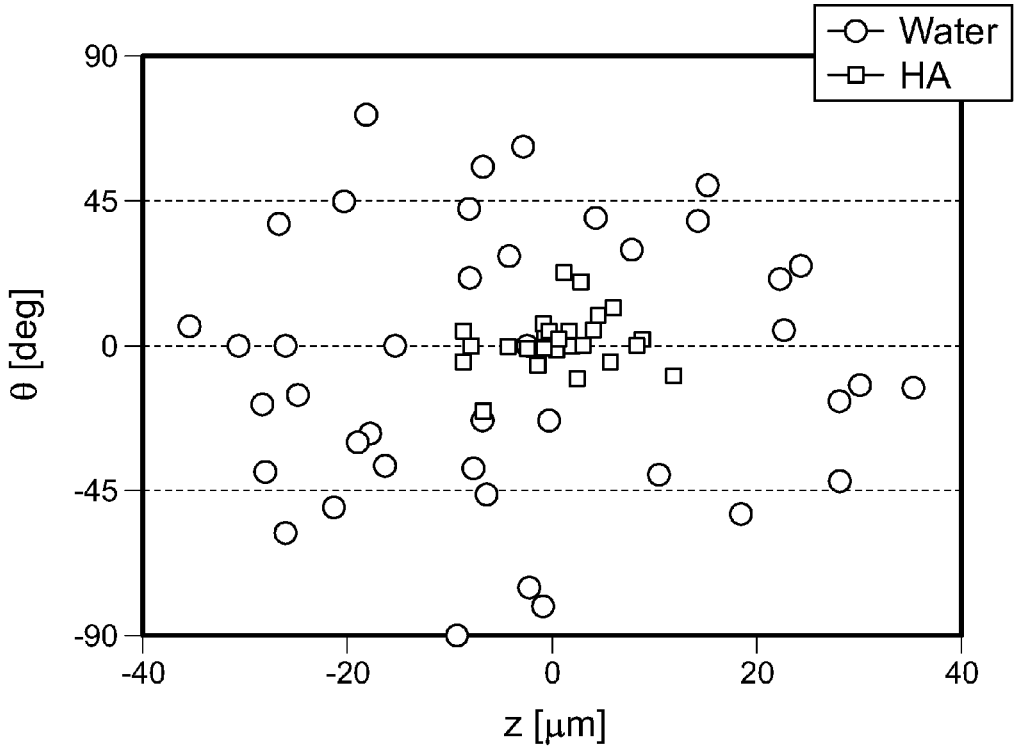
FIG. 15J is a plot showing measurements of lateral position z and instantaneous orientation angle θ plotted for each PEG particle in water and in the HA solution.

Example 11—Studying the Effect of Particle Shape on Inertio-Elastic Focusing in HA Solution at High Reynolds Numbers Recent work has suggested that inertial focusing of non-spherical particles depends on the rotational diameter of a particle, regardless of its cross-sectional shape. Microscopic video imaging also shows that these particles rotate freely when suspended in a Newtonian fluid. To investigate the effect of particle shape on inertio-elastic focusing in HA solution at high Reynolds numbers, cylindrical cross-linked PEG particles synthesized via flow lithography were used. For a given PEG particle, the lateral position $z_p$ (with channel centerline defined by z=0 μm) and the instantaneous orientation angle $\theta_p$ of the particle (with streamwise alignment defined by θ=0°) in the original HA solution at Q=20 ml·min$^{-1}$ were measured (FIG. 15H, 15I, 15J). PEG particles in water occupied the entire range of lateral positions (−40≤z≤40 μm) and orientations (−90°≤θ≤90°). By contrast, in the HA solution, the PEG particles exhibited strong streamwise alignment along the channel centerline with $z_p\rightarrow0$ and $\theta_p\rightarrow0$. Similar streamwise alignment and migration to the centerline has been predicted in numerical simulations of the sedimentation of anisotropic particles in viscoelastic suspending fluids.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

The invention claimed is:

1. A method for focusing particles suspended within a moving Newtonian fluid, the method comprising:

adding a drag-reducing polymer to the Newtonian fluid;

providing a substrate including a channel having an inlet and an outlet; and driving the Newtonian fluid that carries suspended particles through the channel at a volumetric flow rate of at least 0.6 ml/minute that results in the formation of a laminar flow and a localized pathline in the Newtonian fluid at or near a center of the channel, wherein the localized pathline defines a width that is substantially equal to or greater than a hydraulic diameter of the particles;

wherein the particles in the Newtonian fluid are focused into the localized pathline.

2. The method of claim 1, wherein the drag-reducing polymer includes hyaluronic acid (HA).

3. The method of claim 2, wherein a molecular weight of the HA is between 350 kDa and 1650 kDa.

4. The method of claim 1, wherein the volumetric flow rate is between 0.6 ml/min and 50 ml/min.

5. The method of claim 4, wherein the Newtonian fluid is driven through the channel at a volumetric flow rate resulting in a Reynolds number of the flow of between 100 and 10,000.

6. The method of claim 5, wherein the Newtonian fluid is driven through the channel at a volumetric flow rate resulting in a Reynolds number of the flow of between 100 and 4500.

7. The method of claim 1, wherein the suspended particles comprise at least one of rigid beads, mammalian cells, hydrogel particles or white blood cells (WBCs).

8. The method of claim 1, wherein the particles suspended within the moving Newtonian fluid have a diameter a, and the channel has a hydraulic diameter D selected such that a ratio of particle diameter a to channel hydraulic diameter D is greater than 0.1.

9. A system for focusing particles suspended within a moving Newtonian fluid, the system comprising:

a substrate including a channel having an inlet and an outlet;

a Newtonian fluid having a dynamic viscosity that varies with shear rate and that carries suspended particles, mixed with a drag-reducing polymer;

a pump to drive the Newtonian fluid through the channel at a volumetric flow rate that results in the formation of a laminar flow and a localized pathline in the Newtonian fluid at or near a center of the channel, wherein the localized pathline defines a width that is substantially equal to or greater than a hydraulic diameter of the particles; and a controller configured to control operation of the pump based on dynamic viscosity and volumetric flow rate of the Newtonian fluid, wherein during use the controller is configured to control the pump to drive the Newtonian fluid through the channel at a volumetric flow rate of at least 0.6 ml/minute while maintaining a laminar flow such that the system focuses the particles in the Newtonian fluid into the localized pathline.

10. The system of claim 9, wherein the drag-reducing polymer includes hyaluronic acid (HA).

11. The system of claim 9, wherein the pump is configured to control to drive the fluid through the channel at a volumetric flow rate resulting in a Reynolds number of the flow of between 100 and 10,000.

12. The system of claim 11, wherein the pump is configured to control to drive the fluid through the channel at a volumetric flow rate resulting in a Reynolds number of between 2,000 and 4500.

13. A method for focusing particles suspended within a moving viscoelastic Newtonian fluid, the method comprising:

adding a drag-reducing polymer to the viscoelastic Newtonian fluid;

providing a substrate including a channel having an inlet and an outlet; and driving the viscoelastic Newtonian fluid that carries suspended particles through the channel at a volumetric flow rate of at least 0.6 ml/minute that results in the formation of a laminar flow and a localized pathline in the viscoelastic Newtonian fluid at or near a center of the channel, wherein the localized pathline defines a width that is substantially equal to or greater than a hydraulic diameter of the particles, wherein the particles in the viscoelastic Newtonian fluid are focused into the localized pathline.

14. The method of claim 13, wherein the viscoelastic Newtonian fluid is driven at a Weissenberg number that is at least 10% of a Reynolds number of the viscoelastic Newtonian fluid flow, wherein the Weissenberg number is defined as $\lambda$*U/H, where $\lambda$ is a relaxation time of the viscoelastic Newtonian fluid, U represents the volumetric flow rate and H is a cross-sectional dimension of the channel.

15. The method of claim 13, wherein the drag-reducing polymer includes hyaluronic acid (HA).

16. The method of claim 13, wherein the volumetric flow rate is between 0.6 ml/min and 50 ml/min.

17. The method of claim 16, wherein the viscoelastic Newtonian fluid is driven through the channel at a volumetric flow rate resulting in a Reynolds number of the flow of between 100 and 4500.

* * * * *